US007857407B2

(12) United States Patent
Yamanobe et al.

(10) Patent No.: US 7,857,407 B2
(45) Date of Patent: Dec. 28, 2010

(54) IMAGE FORMING APPARATUS

(75) Inventors: Jun Yamanobe, Kanagawa (JP); Toshiyuki Makuta, Fujinomiya (JP)

(73) Assignee: Fujifilm Corporation, Tokyo (JP)

( * ) Notice: Subject to any disclaimer, the term of this patent is extended or adjusted under 35 U.S.C. 154(b) by 1020 days.

(21) Appl. No.: 11/508,221

(22) Filed: Aug. 23, 2006

(65) Prior Publication Data

US 2007/0046715 A1 Mar. 1, 2007

(30) Foreign Application Priority Data

Aug. 24, 2005 (JP) ..... 2005-242762

(51) Int. Cl.
*B41J 29/38* (2006.01)
*B41J 29/393* (2006.01)
*B41J 2/015* (2006.01)

(52) U.S. Cl. ..... 347/12; 347/19; 347/20; 347/14

(58) Field of Classification Search ..... 347/14, 347/19–20, 12
See application file for complete search history.

(56) References Cited

U.S. PATENT DOCUMENTS 5,610,637 A * 3/1997 Sekiya et al. ..... 347/10
6,386,665 B2 * 5/2002 Takahashi et al. ..... 347/10
6,620,569 B2 * 9/2003 Tsubuko et al. ..... 430/115
6,702,438 B2 * 3/2004 Codos et al. ..... 347/106
7,201,462 B2 * 4/2007 Shibata et al. ..... 347/19
2002/0171697 A1 * 11/2002 Gargir et al. ..... 347/14
2004/0104951 A1 6/2004 Shibata et al.
2005/0179760 A1 * 8/2005 Nakagawa et al. ..... 347/105

FOREIGN PATENT DOCUMENTS

JP 2000-119574 A 4/2000
JP 2004058283 A 7/2002
JP 2005-074654 A 3/2005
JP 2005-074956 A 3/2005

* cited by examiner

*Primary Examiner*—Julian D Huffman
*Assistant Examiner*—Jason S Uhlenhake
(74) *Attorney, Agent, or Firm*—Birch, Stewart, Kolasch & Birch, LLP

(57) ABSTRACT

The image forming apparatus includes: a liquid ejection head including a plurality of nozzles, the liquid ejection head ejecting a first liquid containing a coloring material through the nozzles onto a recording medium while the liquid ejection head and the recording medium are relatively moved in a first direction; an abnormal nozzle identifying device which identifies, out of the nozzles, an abnormal nozzle for which an error in a landing position of the first liquid on the recording medium with respect to a second direction orthogonal to the first direction is not less than a predetermined amount; and a correcting device which corrects dot data in such a manner that a second dot on the recording medium formed from the first liquid subsequently ejected from the abnormal nozzle makes contact with at least part of a first dot on the recording medium formed from the first liquid previously ejected from the abnormal nozzle.

10 Claims, 9 Drawing Sheets

51A
51B
51C
51D
51E
51F
P
110A
110B
110C
110D
110E
110F
120A
122A
120B
122B
124
SUB-SCANNING DIRECTION
MAIN SCANNING DIRECTION 51A
51B
51C
51D
51E
51F
P1
P2
110A
110B
110C
110D
110E
110F
122A
120A
122B
120B
124
SUB-SCANNING DIRECTION
MAIN SCANNING DIRECTION 51A
51B
51C
51D
51E
51F
P
110A
110B
110C
110D
110E
110F
120A
120B
120C
122A
122B
122C
124
SUB-SCANNING DIRECTION
MAIN SCANNING DIRECTION

IMAGE FORMING APPARATUS

BACKGROUND OF THE INVENTION

1. Field of the Invention

The present invention relates to an image forming apparatus, and in particular relates to an image forming apparatus having a liquid ejection head that ejects liquid from a nozzle.

2. Description of the Related Art

In recent years, inkjet recording apparatuses (inkjet printers) have become widespread as image forming apparatuses for forming images such as pictures and documents on recording media. An inkjet recording apparatus forms a desired image on a recording medium by ejecting ink droplets onto the recording medium from nozzles in a head while causing the relative movement between the head and the recording medium.

In an inkjet recording apparatus, in particular in the case where a head for which singling (division printing) is not possible, such as a line head in which a large number of nozzles are arranged over a length in a width direction of the recording medium, is used, streakiness caused by the displacement of landing positions of dots deposited on the recording medium is a large issue. The cause of such displacement of the dot landing position includes, for example, the positions or shapes of nozzles deviating from an ideal state at the head manufacturing stage, and the poor liquid repellency in the vicinity of nozzles.

For example, Japanese Patent Application Publication No. 2004-58283 discloses technique to reduce such streakiness caused by landing position errors. According to an apparatus disclosed in Japanese Patent Application Publication No. 2004-58283, defective nozzles for which the landing position is displaced are determined, and the deposition amount (number of dots or ejection amount) for the defective nozzles and nozzles adjacent thereto is changed so as to suppress the visibility of streakiness.

However, according to the method described in Japanese Patent Application Publication No. 2004-58283, the streakiness is merely made less conspicuous on the basis of the characteristics of human vision, and it is difficult to carry out suitable correction over a broad density range from low density areas to high density areas.

SUMMARY OF THE INVENTION

In view of the above circumstances, it is an object of the present invention to provide an image forming apparatus according to which the visibility of streakiness caused by a landing position error can be reduced effectively and thus a good quality image can be formed.

In order to attain the aforementioned object, the present invention is directed to an image forming apparatus comprising: a liquid ejection head including a plurality of nozzles, the liquid ejection head ejecting a first liquid containing a coloring material through the nozzles onto a recording medium while the liquid ejection head and the recording medium are relatively moved in a first direction; an abnormal nozzle identifying device which identifies, out of the nozzles, an abnormal nozzle for which an error in a landing position of the first liquid on the recording medium with respect to a second direction orthogonal to the first direction is not less than a predetermined amount; and a correcting device which corrects dot data in such a manner that a second dot on the recording medium formed from the first liquid subsequently ejected from the abnormal nozzle makes contact with at least part of a first dot on the recording medium formed from the first liquid previously ejected from the abnormal nozzle.

According to this aspect of the present invention, the abnormal nozzle deposits the first liquid continuously in such a manner that the deposited dots make contact with one another. As a result, a flat dot that spreads out in the second direction is formed on the recording medium, and the visibility of streakiness caused by a liquid landing position error can be reduced effectively.

Preferably, in a case where there are the abnormal nozzles adjacent to one another in a projected nozzle row obtained by projecting the nozzles so that the nozzles are aligned in the second direction, the correcting device corrects the dot data in such a manner that a third dot formed by one of the abnormal nozzles and a fourth dot formed by the other of the abnormal nozzles are not aligned in the second direction.

According to this aspect of the present invention, even in the case where there are abnormal nozzles adjacent to one another in the projected nozzle row obtained by projecting the nozzles so that the nozzles are aligned in the second direction, the flat dot spreads out well in the second direction, and hence the visibility of the streakiness can be reduced reliably.

In particular, in the case where there are at least two of the abnormal nozzles adjacent to one another in the projected nozzle row obtained by projecting the nozzles so that the nozzles are aligned in the second direction, a mode is preferable in which the correcting device corrects the dot data so that the third dot formed by one of the abnormal nozzles and the fourth dot formed by another one of the abnormal nozzles are not aligned with one another in the second direction, and the third dot and the fourth dot make contact with one another on the recording medium.

Preferably, in a case where the abnormal nozzle is not adjacent to another abnormal nozzle in a projected nozzle row obtained by projecting the nozzles so that the nozzles are aligned in the second direction, the correcting device also corrects the dot data for a nozzle adjacent to the abnormal nozzle on a side opposite to a side on which the error with respect to the second direction arises.

According to this aspect of the present invention, even in the case where none of the abnormal nozzles are adjacent to one another in the projected nozzle row obtained by projecting the nozzles so that the nozzles are aligned in the second direction, in other words, in the case where an abnormal nozzle is present alone, the visibility of the streakiness can be reduced effectively.

In a case where the abnormal nozzle is not adjacent to another abnormal nozzle in a projected nozzle row obtained by projecting the nozzles so that the nozzles are aligned in the second direction, the correcting device may also correct the dot data for a nozzle adjacent to the abnormal nozzle on a side opposite to a side on which dots formed by droplets ejected from the abnormal nozzle are misaligned with respect to the second direction.

In particular, in the case where none of the abnormal nozzles are adjacent to one another in the projected nozzle row, a mode is preferable in which the correcting device corrects the dot data so that a fifth dot formed by a nozzle adjacent to the abnormal nozzle on the opposite side to the direction in which the error arises in the second direction and the first dot make contact with one another on the recording medium.

Preferably, a total number of dots formed by the abnormal nozzle in a predetermined area according to the dot data which is not corrected by the correcting device is the same as a total number of dots formed by the abnormal nozzle in the predetermined area according to the dot data which is corrected by the correcting device.

According to this aspect of the present invention, the total amount of the coloring material conferred to the recording medium does not change between before and after the correction of the dot data, and hence the macroscopic density is unchanged. A good quality image can thus be obtained.

Preferably, the image forming apparatus further comprises an attaching device which attaches a second liquid containing a diffusion preventing agent for the coloring material onto the recording medium before the first liquid is attached onto the recording medium.

According to this aspect of the present invention, the formation of a flat dot that spreads out in the second direction can be promoted, and the liquid deposition interference can be prevented.

Preferably, the image forming apparatus further comprises a radiation irradiation device which radiates radiation onto the recording medium, wherein one of the first liquid and the second liquid further contains a radiation-curable polymerizable compound, and the other further contains a polymerization initiator.

According to this aspect of the present invention, the first liquid and the second liquid can be fixed onto the recording medium rapidly, and hence a good quality image can be formed.

Preferably, the second liquid further contains a high-boiling organic solvent.

According to this aspect of the present invention, the liquid deposition interference can be prevented reliably while a flat dot that spreads out in the second direction is formed.

According to the present invention, an abnormal nozzle deposits the first liquid continuously so that the deposited dots make contact with one another, and a flat dot that spreads out in the second direction is formed on the recording medium. Hence, the visibility of streakiness caused by the liquid landing position error can be reduced effectively.

BRIEF DESCRIPTION OF THE DRAWINGS

The nature of this invention, as well as other objects and benefits thereof, will be explained in the following with reference to the accompanying drawings, wherein.

DESCRIPTION OF THE PREFERRED EMBODIMENTS

Configuration of Inkjet Recording Apparatus

Figure 1:
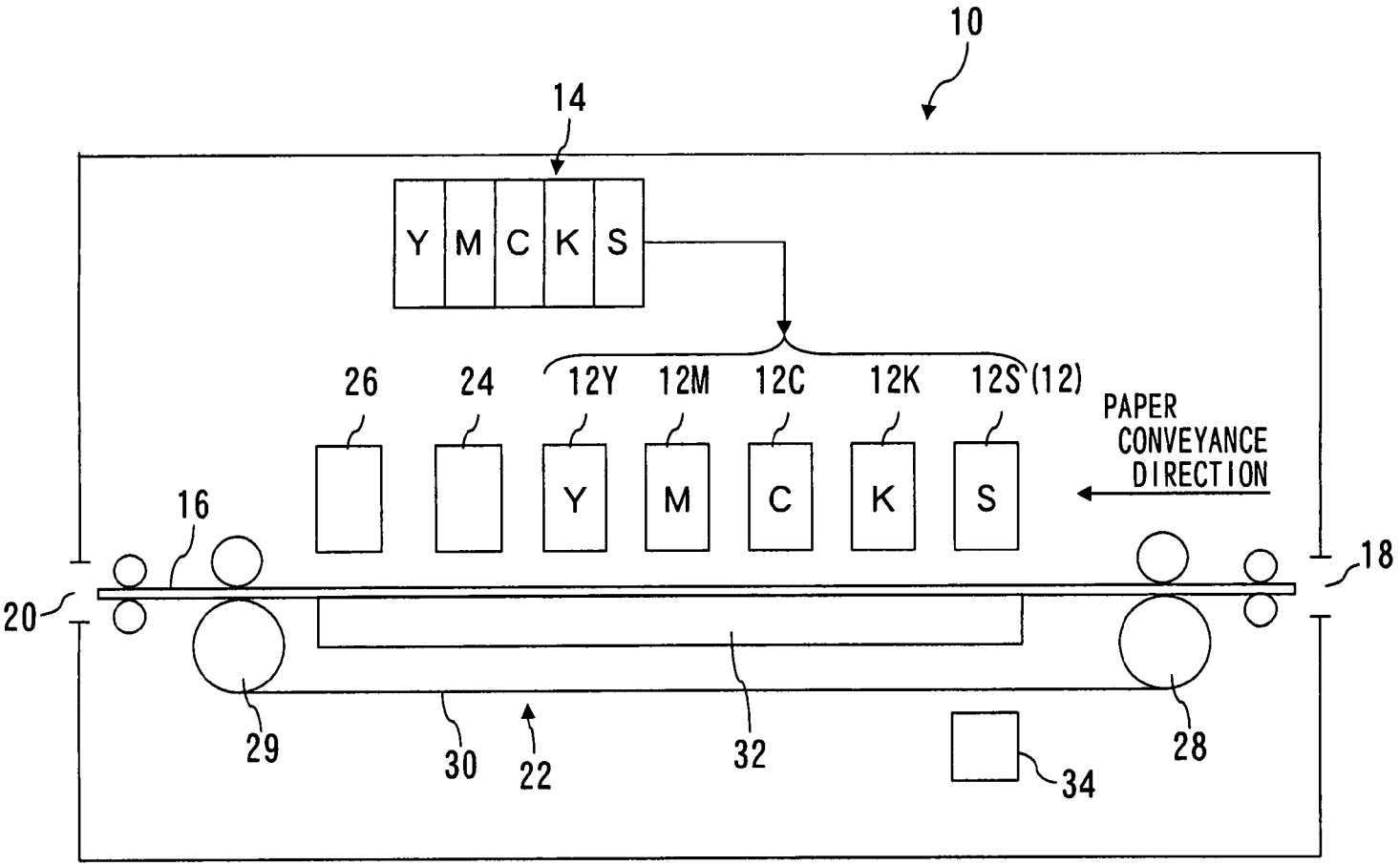
FIG. 1 is a general schematic drawing of an inkjet recording apparatus according to an embodiment of the present invention.

FIG. 1 is a general schematic drawing of an inkjet recording apparatus according to an embodiment of the present invention. The inkjet recording apparatus 10 shown in the present embodiment is a two-liquid system of inkjet recording apparatus in which a treatment liquid and colored inks that have been deposited on the surface of a recording medium are irradiated with ultraviolet radiation (UV) so as to bring about polymerization.

As shown in FIG. 1, the inkjet recording apparatus 10 comprises: a plurality of ejection heads 12 (12S, 12K, 12C, 12M, 12Y) that eject respectively inks of the various colors black (K), cyan (C), magenta (M), and yellow (Y), and a treatment liquid (S) that reacts with these inks; a liquid storing/loading unit 14 that stores the various colored inks and the treatment liquid; a paper supply unit 18 that supplies a recording medium 16; a discharge unit 20 that discharges the recording medium after recording (the printed article) to the outside; a conveyance unit 22 that conveys the recording medium 16 while maintaining the flatness of the recording medium 16; a UV light source 24 that radiates UV onto an area of the recording medium 16 onto which the ejection heads 12 have deposited droplets; and a print determination unit 26 that reads the results of the printing of the ejection heads 12.

The paper supply unit 18 comprises, for example, a paper roll (continuous paper) magazine. A plurality of magazines with different paper widths, paper qualities or the like may be provided together. Moreover, instead of a paper roll magazine, or used together therewith, paper may be supplied by a cassette in which sheets of cut paper are loaded stacked on one another.

In the case of a configuration in which a plurality of types of recording medium can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The conveyance unit 22 has a structure in which an endless belt 30 is set around rollers 28 and 29, and is configured such that at least a portion thereof facing the ejection heads 12, the UV light source 24, and the print determination unit 26 is flat.

The belt 30 has a width that is greater than the width of the recording medium 16, and a large number of suction holes (not shown) are formed in the belt surface. A suction chamber 32 is provided in a position facing the ejection heads 12S, 12K, 12C, 12M, 12Y, the UV light source 24, and the print determination unit 26 on the interior side of the belt 30, which is set around the rollers 28 and 29. A negative pressure is generated by sucking out from the suction chamber 32 using a fan (not shown), whereby the recording medium 16 is held on the belt 30 by suction. Power from a motor (not shown) is transmitted to at least one of the rollers 28 and 29 around which the belt 30 is set, whereby the belt 30 is driven in a counterclockwise direction in FIG. 1, so that the recording medium 16 held on the belt 30 is conveyed from the right to the left in FIG. 1.

Since ink adheres to the belt 30 when a marginless print job or the like is performed, a belt-cleaning unit 34 is disposed in a predetermined position (a suitable position outside the printing area) on the exterior side of the belt 30. Although the details of the configuration of the belt-cleaning unit 34 are not shown, examples thereof include a configuration in which the belt 30 is nipped with cleaning rollers such as a brush roller and a water absorbent roller, an air blow configuration in which clean air is blown onto the belt 30, or a combination of these. In the case of the configuration in which the belt 30 is nipped with the cleaning rollers, it is preferable to make the line velocity of the cleaning rollers different from that of the belt 30 to improve the cleaning effect.

The inkjet recording apparatus 10 may comprise a roller nip conveyance mechanism, in which the recording paper 16 is pinched and conveyed with nip rollers, instead of the belt conveyance unit 22. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

Each of the ejection heads 12 (12S, 12K, 12C, 12M, 12Y) is a full line type head (line head) that has a length corresponding to the maximum paper width that can be handled by the inkjet recording apparatus 10, and is installed so as to extend in a direction (the main scanning direction) substantially orthogonal to the paper conveyance direction (sub-scanning direction) of the recording medium 16. Each of the ejection heads 12 has a plurality of nozzles from which a predetermined liquid (a colored ink or the treatment liquid) is ejected and which are arranged in an ejection surface facing the recording medium 16 over a length exceeding one side of the maximum size of the recording medium (i.e. the whole width of the area over which an image may be formed).

From the upstream side in the paper conveyance direction in FIG. 1, the ejection heads are disposed in order the ejection head (treatment liquid ejection head) 12S which ejects the treatment liquid (S), and then the ejection heads (ink ejection heads) 12K, 12C, 12M, and 12Y which eject respectively the black (K), cyan (C), magenta (M), and yellow (Y) colored inks.

The liquid storing/loading unit 14 has tanks in which are stored respectively the treatment liquid and the various colored inks ejected by the ejection heads 12 (12S, 12K, 12C, 12M, 12Y). The tanks are communicated to the ejection heads 12 respectively via pipelines (not shown). Moreover, the liquid storing/loading unit 14 has a notification device (display device, warning alarm generating device, etc.) that notifies the condition if the remaining amount of each liquid becomes low, and also has a mechanism for preventing the liquids from being confused with one another when being loaded.

The UV light source 24 in installed so as to extend in a direction (the main scanning direction) substantially orthogonal to the paper conveyance direction of the recording medium 16, namely, in the paper width direction of the recording medium 16, and is configured so as to be able to radiate UV over at least an area of the recording medium 16 onto which the ejection heads 12 deposit droplets. A metal halide lamp or the like can be used as the UV light source 24.

The print determination unit 26 is configured with at least a line sensor having rows of photoelectric transducing elements with a width that is greater than the ejection width of the ejection head 12 (image recording width). This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally. The print determination unit 26 uses the line sensor to read the results of the droplet deposition by the ejection heads 12, and evaluates the ejection (determines whether or not the ejection has taken place, measures the dot size, measures the dot landing position, etc.), and thus acts as a device which identifies abnormal nozzles for which a displacement in a liquid landing position arises, and checks for nozzle clogging and other ejection defects.

Although the compositions of the treatment liquid and the inks used in the inkjet recording apparatus 10 according to the present embodiment are described in detail later, the configuration is such that the treatment liquid contains a polymerization initiator, a diffusion preventing agent (coagulant), and an oil (high-boiling organic solvent), and each colored ink contains a UV monomer (ultraviolet radiation-curable monomer) and a coloring material (colorant). According to this combination of the treatment liquid and the colored inks, image degradation due to liquid deposition interference can be avoided primarily through the action of the diffusion preventing agent contained in the treatment liquid, and moreover even in the case where leaked light or reflected light from the UV light source 24 strikes the nozzles of the ejection heads 12, polymerization does not occur since none of the liquids contains both the polymerization initiator and the UV monomer together. In this way, solidification of the treatment liquid and the colored inks in the nozzles of each of the ejection heads 12 can be prevented. Moreover, in the case of a mode in which each colored ink contains the polymerization initiator and the treatment liquid contains the UV monomer, effects as above can be brought about.

Note that each colored ink may contain a UV oligomer instead of, or as well as, the UV monomer. Furthermore, each colored ink may contain an ultraviolet radiation-curable polymerizable compound such as a mixture of a UV monomer and a UV oligomer.

According to the above configuration, the ejection head 12S disposed furthest upstream in the paper conveyance direction ejects the treatment liquid onto the recording medium 16. Then, when the treatment liquid on the recording medium 16 has moved to be substantially directly under the ejection head 12K positioned downstream in the paper conveyance direction by conveying the recording medium 16, the ejection head 12K ejects the black (K) ink in such a manner that the black ink overlap with the treatment liquid. Regarding the timing of the ejection by the ejection head 12K, the timing to be carried out may be determined by a sensor, or the timing may be determined by measuring a time or a pulse from a reference point. Next, the ejection heads 12C, 12M, and 12Y positioned downstream in the paper conveyance direction eject respectively the inks of the colors C, M, and Y onto the area of the recording medium 16 onto which the treatment liquid has been attached. By depositing the treatment liquid prior to the inks in this way, image degradation caused by the liquid deposition interference can be prevented. The UV light source 24 positioned after the ejection heads 12S, 12K, 12C, 12M, and 12Y in the paper conveyance direction then radiates UV onto the mixture of the treatment liquid and the colored inks on the recording medium 16. Upon the mixture being irradiated with UV, radicals are generated from the curing initiator (polymerization initiator) contained in the treatment liquid, and polymerization occurs between the treatment liquid and the inks. In this way, the image (dots) formed from the inks is (are) put into a cured state, thus fixing the image on the recording medium 16. Note that before the mixing of the treatment liquid and the inks, polymerization does not occur since none of the treatment liquid and the inks contains both the polymerization initiator and the UV monomer together. Hence, as described above, even if irradiation with UV from the UV light source 24 is carried out before the ejection heads 12 deposit droplets, ejection defects such as nozzle clogging do not occur. A good quality image can thus be formed on the recording medium 16.

Note that in the present example, a KCMY standard color (four-color) configuration has been described, but with regard to the ink colors and the number and combination thereof, there are no limitations to the present embodiment. Rather, light inks and dark inks may be added as required. For example, a configuration in which light inks such as light cyan and light magenta are ejected is possible.

Configuration of Ejection Heads

Figure 2:
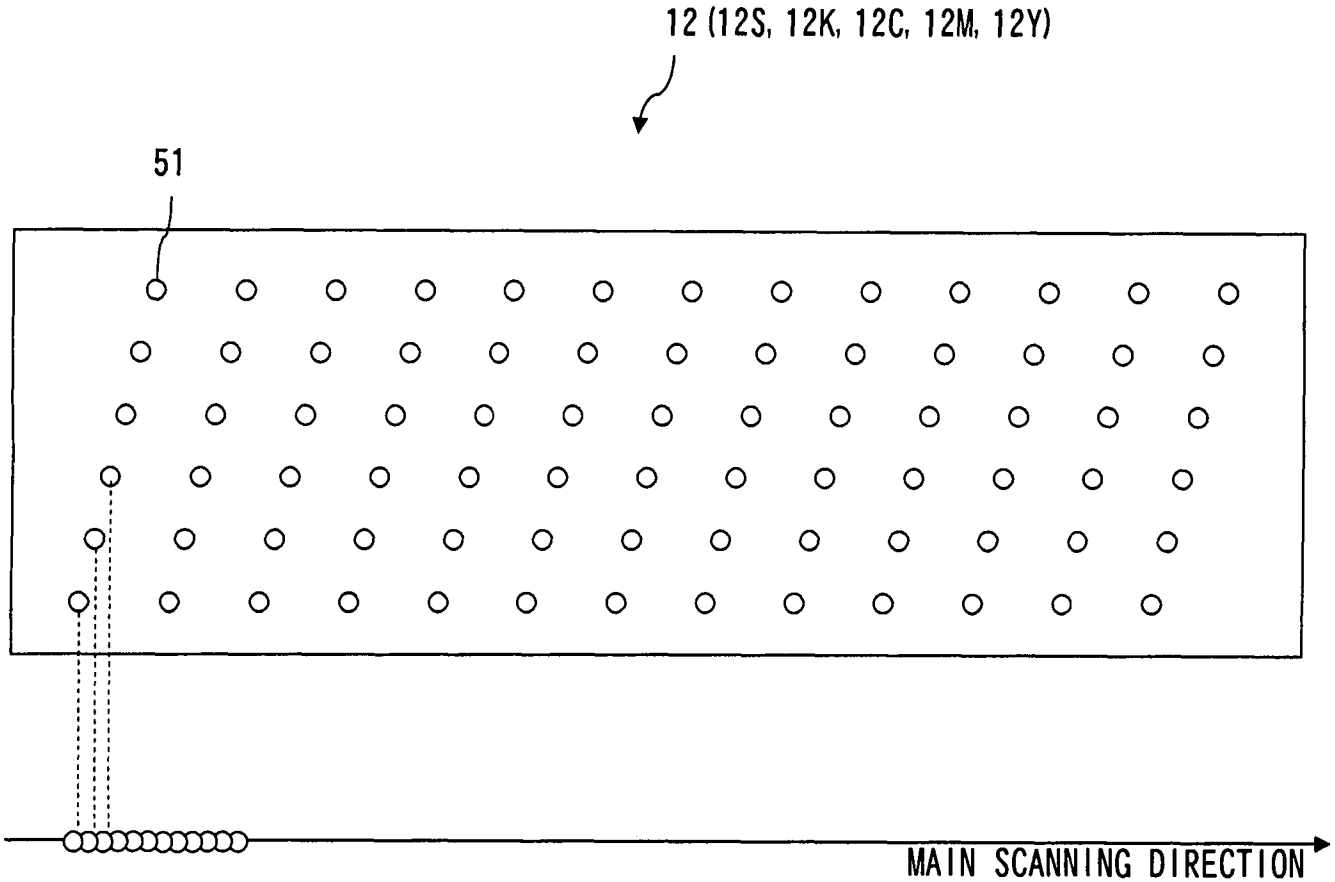
FIG. 2 is a plan view showing an ejection surface of an ejection head.
Figure 3:
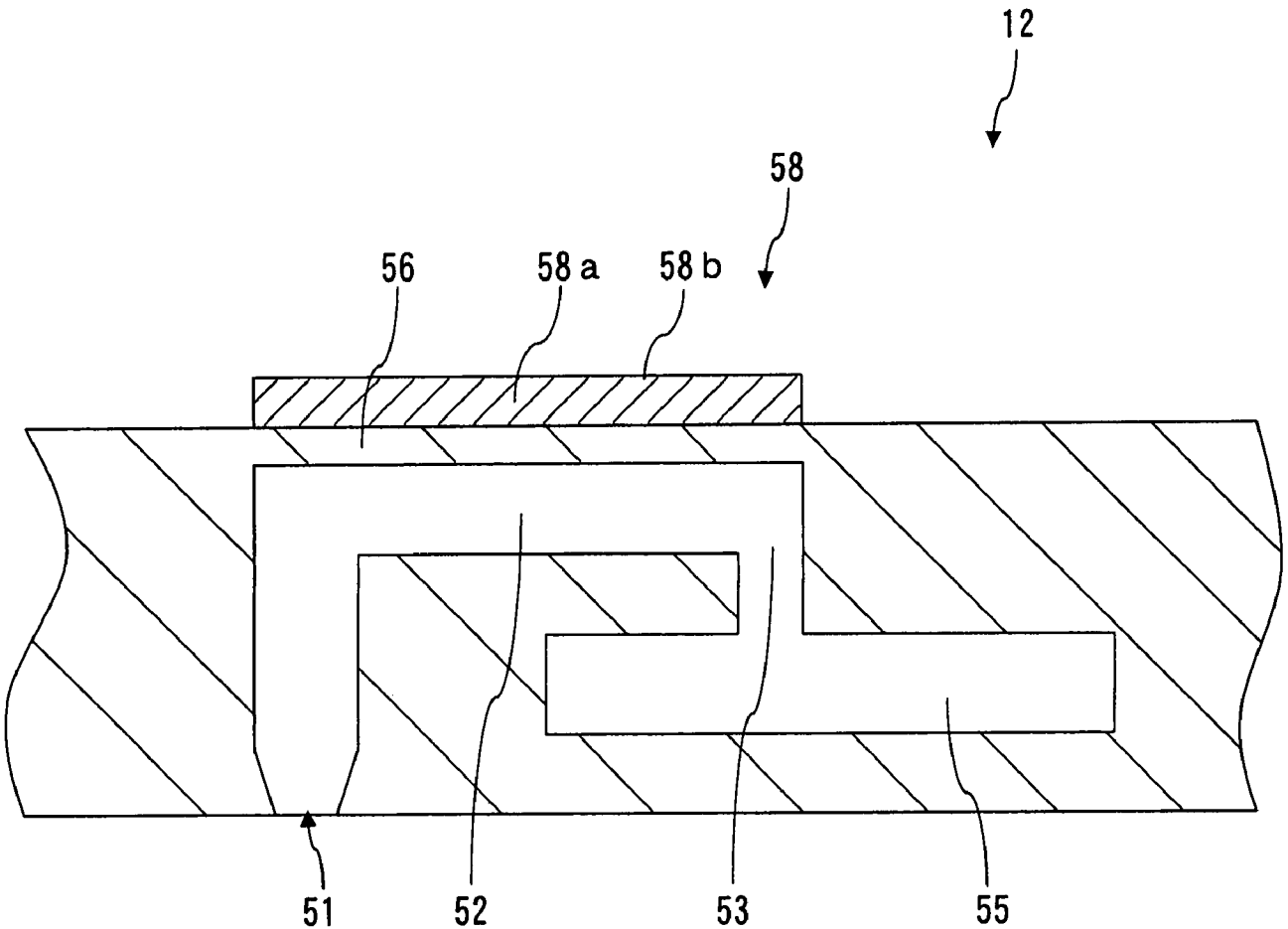
FIG. 3 is a side sectional view showing part of the ejection head.

FIG. 2 is a plan view showing an ejection surface of one of the ejection heads 12 (12S, 12K, 12C, 12M, 12Y). As shown in FIG. 3, nozzles 51 from which a predetermined liquid (colored ink or treatment liquid) is ejected are formed in a (two-dimensional) staggered matrix shape in the ejection surface of the ejection head 12. In a projected nozzle row obtained by projecting the nozzles along the main scanning direction (in the main scanning direction), the nozzles are arranged at equal intervals with a constant nozzle pitch, whereby the dot pitch is effectively made to be of higher density.

FIG. 3 is a side sectional view showing part of the ejection head 12. As shown in FIG. 3, pressure chambers 52 each of which communicates with one of the nozzles 51 are formed inside the ejection head 12. Each pressure chamber 52 communicates with a common channel 55 via a supply port 53 formed in one end of the pressure chamber 52. The common channel 55 has stored therein the predetermined liquid (colored ink or treatment liquid) which is supplied from an ink tank (not shown) disposed in the liquid storing/loading unit 14 shown in FIG. 1. This liquid is supplied from the common channel 55 via the supply port 53 into the pressure chamber 52.

An upper wall of the pressure chambers 52 is constructed as a diaphragm 56. Piezoelectric elements 58 that are positioned in correspondence with the pressure chambers 52 are joined to a surface of the diaphragm 56 (on a side across the diaphragm 56 from the pressure chambers 52). Each piezoelectric element 58 has a structure in which an individual electrode (driving electrode) 58*b* is provided on an upper surface of a thin film-shaped piezoelectric body 58*a*. The diaphragm 56 is made of a conductive material, and thus also acts as a common electrode for the plurality of piezoelectric elements 58.

According to this configuration, upon a predetermined driving voltage (driving signal) being applied to a piezoelectric element 58, the diaphragm 56 bends toward the corresponding pressure chamber 52 due to deformation of the piezoelectric element 58, whereby the liquid in the pressure chamber 52 is pressurized. A liquid droplet is thus ejected from the nozzle 51 connected to the pressure chamber 52. After that, upon the application of the driving voltage being lifted, the diaphragm 56 returns to its original state, whereby the predetermined liquid is again supplied into the pressure chamber 52 via the supply port 53 from the common channel 55, so as to become ready for the next droplet ejection operation.

Description of Control System

Figure 4:
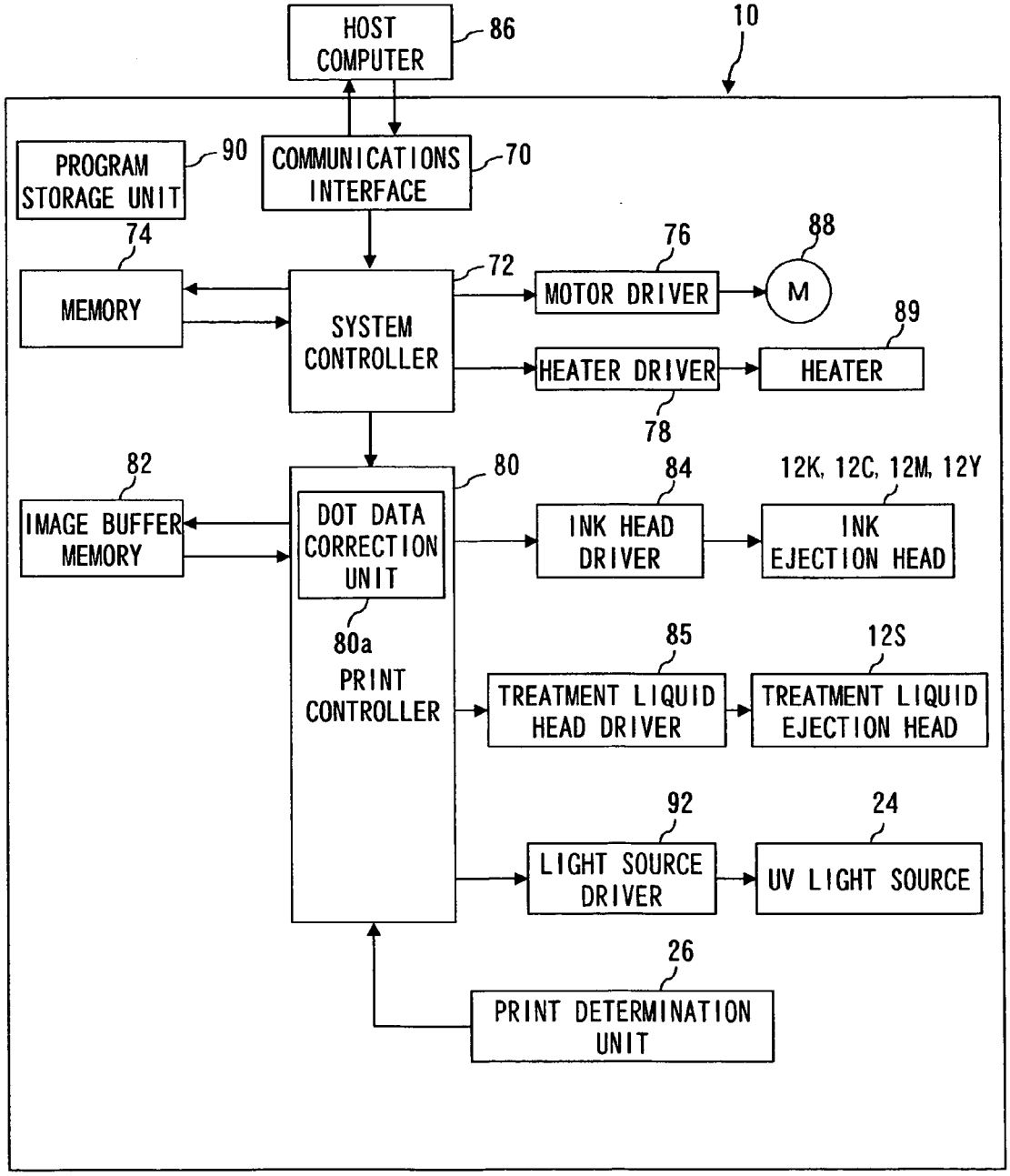
FIG. 4 is a principal block diagram showing the system configuration of the inkjet recording apparatus.

FIG. 4 is a principal block diagram showing the system configuration of the inkjet recording apparatus 10. The inkjet recording apparatus 10 comprises a communications interface 70, a system controller 72, a memory 74, a motor driver 76, a heater driver 78, a print controller 80, an image buffer memory 82, an ink head driver 84, a treatment liquid head driver 85, a light source driver 92, a print determination unit 26, and the like.

The communications interface 70 is an interface unit for receiving image data sent from a host computer 86. A serial interface or a parallel interface may be used as the communications interface 70. A buffer memory (not shown) may be mounted in this portion in order to increase the communication speed. The image data sent from the host computer 86 is received by the inkjet recording apparatus 10 through the communications interface 70, and is temporarily stored in the memory 74.

The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is constituted from a central processing unit (CPU), peripheral circuits, and so on, and functions as a controller that carries out overall control of the inkjet recording apparatus 10 in accordance with a predetermined program, and also functions as a calculating apparatus that carries out various calculations. That is, the system controller 72 controls the various units such as the communications interface 70, the memory 74, the motor driver 76, and the heater driver 78, and carries out control of communication with the host computer 86, control of writing and reading to and from the memory 74, and so on, and also produces control signals for controlling a motor 88 such as a conveyance system motor, and a heater 89 such as a heater for adjusting the temperature of the inkjet recording apparatus 10 (the ejection heads etc.).

The program executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver 76 is a driver (driving circuit) that drives the motor 88 in accordance with commands from the system controller 72. The heater driver 78 is a driver that drives the heater 89 such as the heater for adjusting the temperature of the inkjet recording apparatus 10 (the ejection heads etc.) in accordance with commands from the system controller 72.

The print controller 80 is a controller that has a signal processing function of carrying out various processing, correction and so on for producing printing controlling signals from the image data in the memory 74 in accordance with control from the system controller 72, and supplies the printing data (dot data) thus produced to the ink head driver 84 and the treatment liquid head driver 85. Required signal processing is carried out in the print controller 80, and then control of the ejection amount and the ejection timing for the ink droplets from the ink ejection heads 12K, 12C, 12M, and 12Y is carried out via the ink head driver 84 on the basis of the image data. Control of the ejection amount and the ejection timing for the treatment liquid droplets from the treatment liquid ejection head 12S is similarly carried out via the treatment liquid head driver 85 on the basis of the image data. As a result, a desired dot size and dot arrangement is realized.

The print controller 80 is provided with the image buffer memory 82; and image data, parameters, and other data are temporarily stored in the image buffer memory 82 when image data is processed in the print controller 80. Also possible is an aspect in which the print controller 80 and the system controller 72 are integrated to form a single processor.

The ink head driver 84 drives the piezoelectric elements 58 (see FIG. 3) of the ink ejection heads 12K, 12C, 12M, and 12Y on the basis of the printing data supplied from the print controller 80. The treatment liquid head driver 85 similarly drives the piezoelectric elements 58 (see FIG. 3) of the treatment liquid ejection head 12S on the basis of the printing data. The head drivers 84 and 85 may each include a feedback control system for keeping the head driving conditions constant.

The light source driver 92 functions as a control block that controls on/off (the irradiation timing, the irradiation duration), the irradiation dose, and so on for the UV light source 24. That is, the light source driver 92 controls on/off for the UV light source 24, and also sets the irradiation dose for the UV light source 24, on the basis of control signals supplied from the print controller 80.

As described with reference to FIG. 1, the print determination unit 26 is a block including a line sensor. The print determination unit 26 reads an image printed on the recording medium 16, carries out required signal processing and so on, determines the printing state (whether or not ejection has taken place, variations in landing position, etc.), and supplies the determination results to the print controller 80.

The image data to be printed is externally inputted through the communications interface 70, and is stored in the memory 74. In this stage, the RGB image data is stored in the memory 74.

The image data stored in the memory 74 is sent to the print controller 80 via the system controller 72, and is converted into dot data for the treatment liquid and dot data for each of the colored inks in the print controller 80. That is, the print controller 80 carries out processing of converting the inputted RGB image data into dot data for the treatment liquid and the four colors KCMY The dot data produced by the print controller 80 is stored in the image buffer memory 82.

The print controller 80 carries out various corrections for the ejection heads on the basis of the data sent from the print determination unit 26 as required. In particular, in the present embodiment, the print controller 80 includes a dot data correction unit 80*a* that carries out correction on the dot data stored in the image buffer memory 82 for reducing streakiness caused by landing position errors of liquids ejected from the nozzles of the ink ejection heads 12K, 12C, 12M, and 12Y This correction is described in detail later.

The head drivers 84 and 85 produce drive control signals for the ejection heads 12K, 12C, 12M, 12Y, and 12S on the basis on the dot data stored in the image buffer memory 82. The drive control signals produced by the head drivers 84 and 85 are applied to the ejection heads 12K, 12C, 12M, 12Y, and 12S, whereby droplets of the treatment liquid and the colored inks are ejected from the ejection heads 12S, 12K, 12C, 12M, and 12Y. The ejection of droplets from the ejection heads 12S, 12K, 12C, 12M, and 12Y is controlled in synchronization with the speed of conveyance of the recording medium 16. As a result, an image is formed on the recording medium 16.

The dots formed from the treatment liquid should make contact with the colored inks corresponding to the treatment liquid dots, and hence the dot size for the treatment liquid may be made to be larger than the dot size for the colored inks, and moreover the density of the treatment liquid dots may be made to be lower than the density of the colored ink dots. That is, the dot data for the treatment liquid and the dot data for the colored inks may be produced such that the dot data for the treatment liquid is different to the dot data for the colored inks.

Various control programs are stored in a program storage unit 90 shown in FIG. 4. The control programs are read out and executed in accordance with commands from the system controller 72. A semiconductor memory such as a ROM or an EEPROM, or a magnetic disk, or the like may be used as the program storage unit 90. An external interface may be provided, and a memory card or a PC card may be used. A plurality of these storage media may of course be provided. Moreover, the program storage unit 90 may also be used as a recording device (not shown) for operational parameters and so on.

In the present example, the system controller 72, the memory 74, the print controller 80 and so on have been shown as individual functional blocks, but a configuration may also be adopted in which these are integrated together to form a single processor. Moreover, some of the functions of the system controller 72 and some of the functions of the print controller 80 may be realized by a single processor.

Description of Deposition Control Method

Figure 5A:
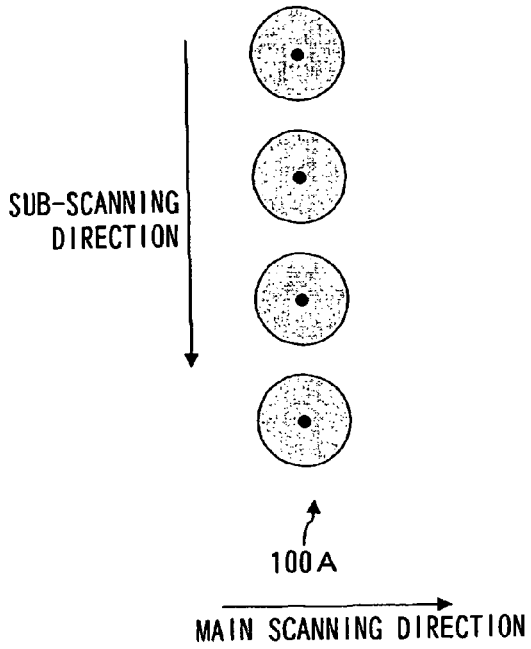
FIGS. 5A, 5B and 5C are explanatory drawings showing intrinsic ink characteristics an embodiment of in the present invention.
Figure 5B:
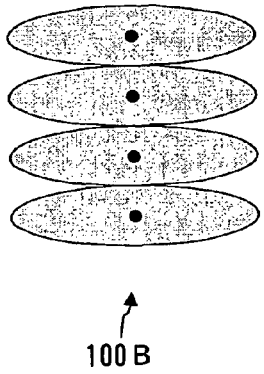
Figure 5C:
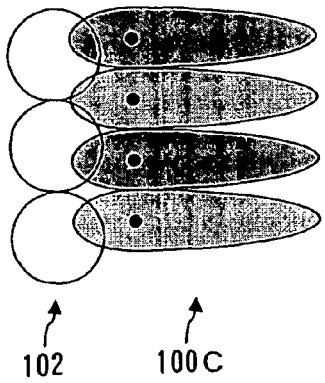

First, intrinsic characteristics of the inks used in the present embodiment are described with reference to FIGS. 5A, 5B and 5C. FIGS. 5A, 5B and 5C show dot rows on a recording medium formed from an ink ejected from a given nozzle.

In the case where the droplet deposition is carried out at a relatively low frequency (low frequency) so that the dots are separated from one another to form a dot row 100A shown in FIG. 5A, each of the dots spreads out in a substantially circular shape. On the other hand, in the case where the droplet deposition is carried out at a relatively high frequency (high frequency) so that the dots make contact with one another to form a dot row 100B shown in FIG. 5B, each of the dots jostles with other adjacent dots in the sub-scanning direction. As a result, each of the dots ends up with a deformed elliptical shape contracted in the sub-scanning direction and spread out (lengthened) in the main scanning direction perpendicular to the sub-scanning direction. Such dots are referred to as "flat dots" hereinafter.

Moreover, dots formed from an ink used in the present embodiment tend to spread out easily in a direction which corresponds to an area in which other dots are not present on the recording medium. FIG. 5C shows a situation in which, in the case where a dot row 102 has already been formed on the recording medium in the sub-scanning direction, dots of a dot row 100C are deposited at a high frequency so as to partially overlap with the dots of the dot row 102. The dots in the dot row 100C thus formed do not spread out much toward the side of the already formed dot row 102, but spread out greatly toward the opposite side (i.e. in a direction in which dots are not present). Accordingly, in such a case, flat dots having left-right asymmetry are formed.

Figures 6A, 6B, 6C:
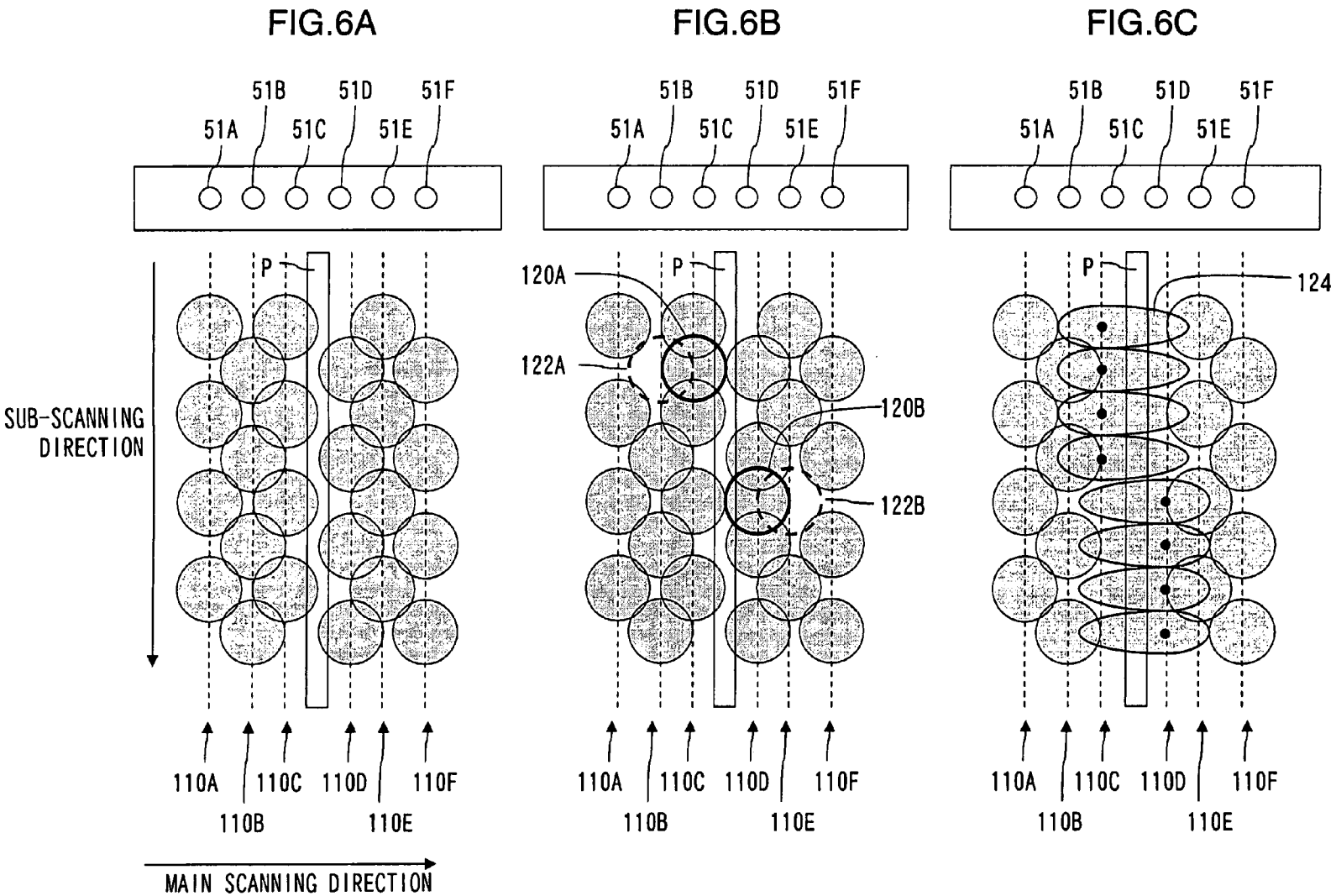
FIGS. 6A, 6B and 6C are explanatory drawings showing the situation of dots in the case where the landing positions of liquids from two nozzles are displaced in a direction away from one another.
Figures 7A, 7B, 7C:
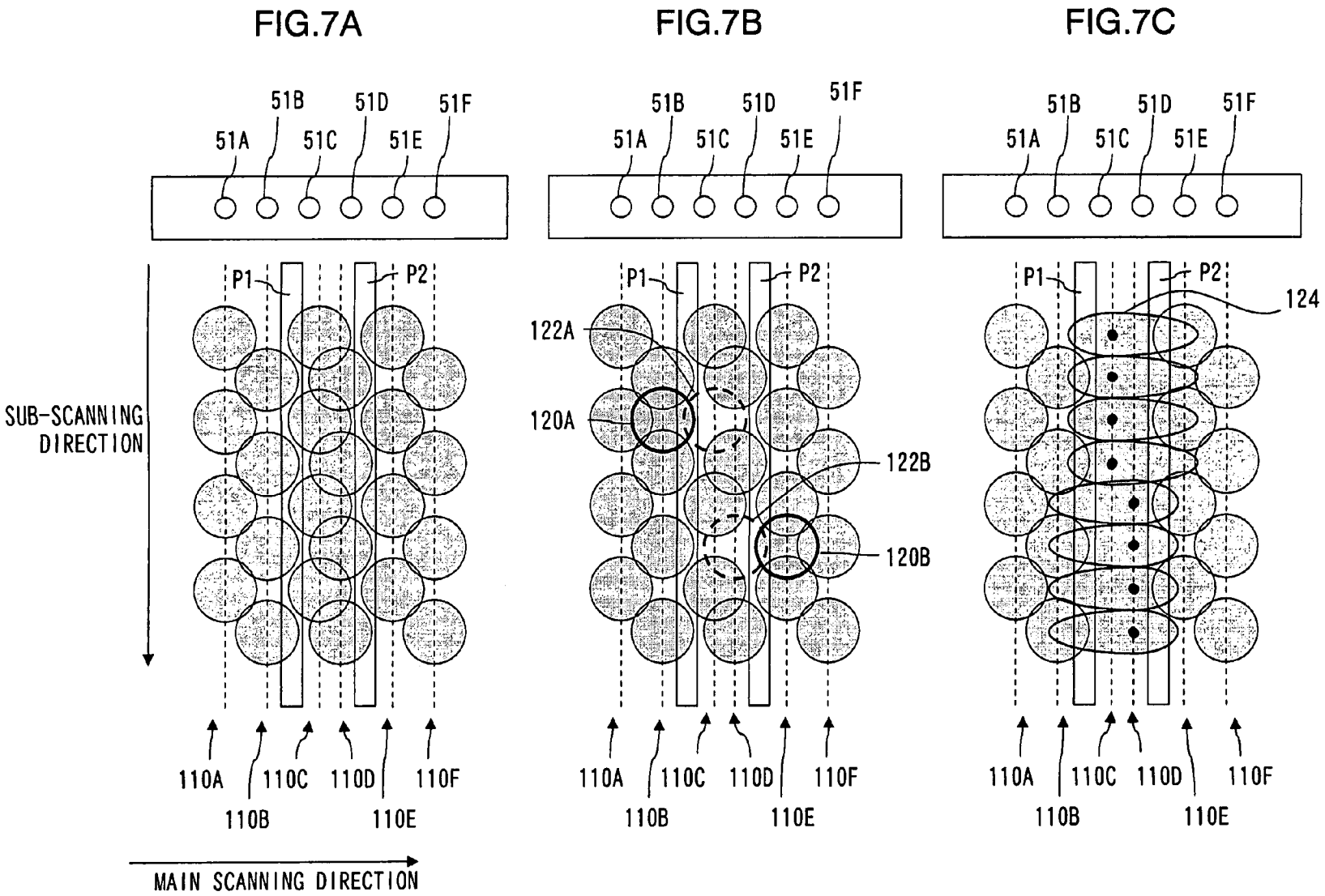
FIGS. 7A, 7B and 7C are explanatory drawings showing the situation of dots in the case where the landing positions of liquids from two nozzles are displaced in a direction toward one another.
Figures 8A, 8B, 8C:
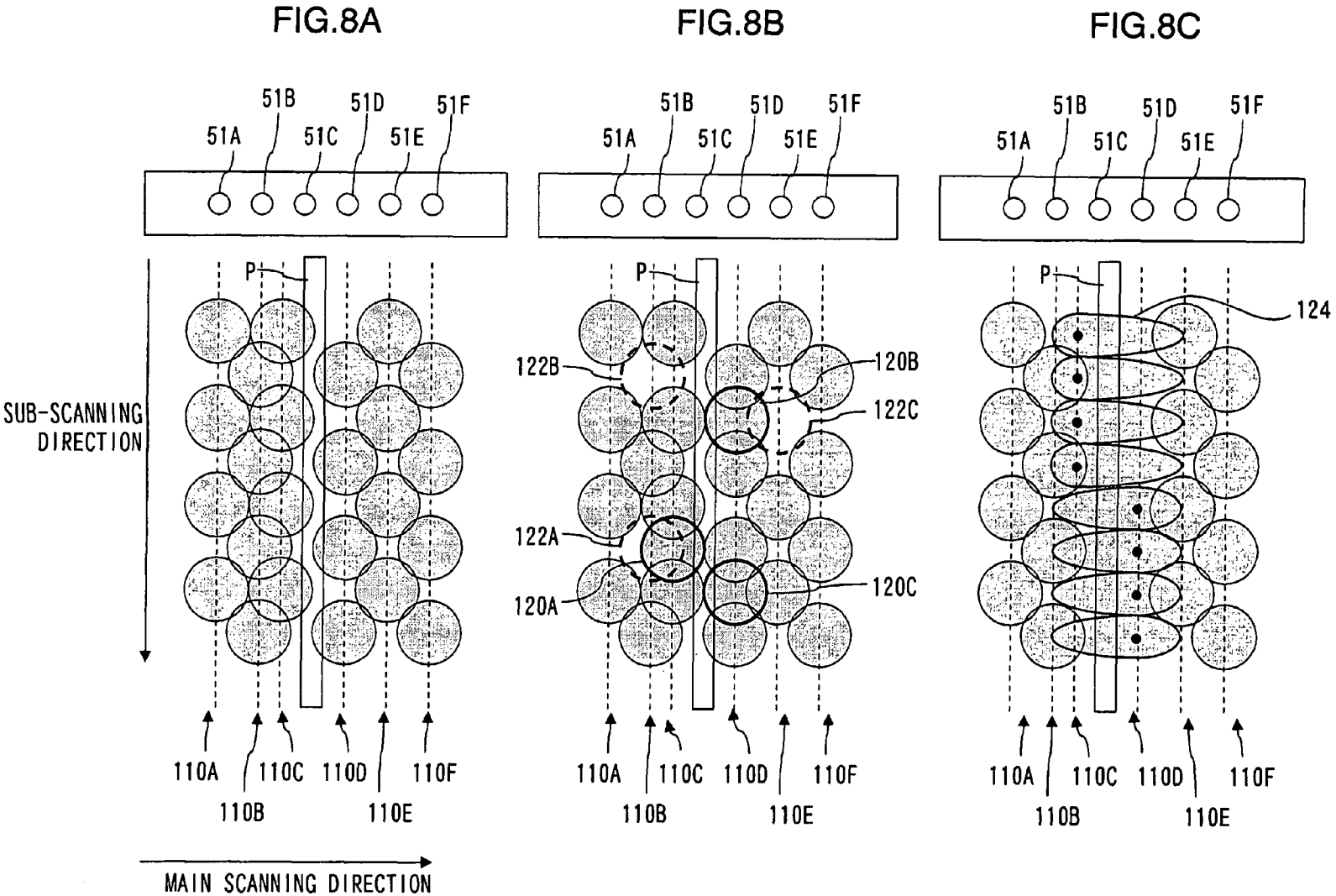
FIGS. 8A, 8B and 8C are explanatory drawings showing the case where the landing positions of liquid from one nozzle only are displaced.

Next, a method of reducing streakiness caused by landing position errors on the basis of the above ink characteristics is described. FIGS. 6A to 8C are all schematic drawings showing a situation when dots have been deposited by nozzles 51A to 51F with a droplet deposition ratio (droplet ejection ratio) of 50%. FIGS. 6A, 7A, and 8A each show a case that correction is not carried out. FIGS. 6B, 7B, and 8B each show a case that a correction method according to the related art is used. FIGS. 6C, 7C, and 8C each show a case that a correction method according to an embodiment of the present invention is used. The dot rows formed by the nozzles 51A to 51F are represented by the reference numerals 110A to 110F respectively. The nozzles 51A to 51F shown in the drawings correspond to part of the projected nozzle row described with reference to FIG. 2, and hence the nozzles 51A to 51F are actually displaced from one another in the sub-scanning direction. Here, the nozzles 51A to 51F are shown in a row for convenience. Moreover, "adjacent nozzles" refers to nozzles that are adjacent to one another in the projected nozzle row, for example the nozzle adjacent to the nozzle 51A is the nozzle 51B.

FIGS. 6A, 6B and 6C show a case in which landing positions of dots deposited by two nozzles 51C and 51D in the center are displaced in a direction away from one another in the main scanning direction. The landing position of each of the dots deposited by the nozzles 51C and 51D is displaced by a prescribed amount in the main scanning direction. In the case in which correction is not carried out as shown in FIG. 6A, the spacing between the dot rows 110C and 110D is wider than the spacing between other adjacent dot rows, and ink (coloring material) is reduced in an area P between the dot rows 110C and 110D, so that a white streak (streakiness) extending in the sub-scanning direction occurs.

Meanwhile, with the correction method according to the related art, as shown in FIG. 6B, dots 120A and 120B are newly added as dots deposited by the nozzles 51C and 51D for which the displacement in the landing position has arisen (i.e. the number of dots in each of the dot rows 110C and 110D in the vicinity of the streakiness is increased), whereby the visibility of the streakiness is reduced. Furthermore, dots 122A and 122B (shown by broken lines) are thinned out from the dots normally deposited by the nozzles 51B and 51E adjacent respectively to the nozzles 51C and 51D. In this way, an increase in the coloring material amount in the vicinity of the white streak accompanying the addition of dots can be prevented. With this correction method according to the related art, the spatial frequency at the streakiness is made to be high, whereby the visibility of the streakiness looks to be reduced from a macroscopic viewpoint; however, from a microscopic viewpoint, the state where little ink exists in the area P is unchanged because ink has not been conferred in the area P, and hence the visibility of the streakiness does not reduced effectively in some senses.

In contrast with this, in the correction method according to the present embodiment of the invention, as shown in FIG. 6C, the nozzles 51C and 51D for which the displacement in the landing position has arisen are each made to deposit dots at high frequency so that the dots make contact with one another, whereby flat dots 124 that are lengthened in the main scanning direction are formed on the recording medium. In this case, in order not to hinder spreading out of the flat dots 124 in the main scanning direction, the dots deposited by the nozzles 51C and 51D are made to not be aligned with one another in terms of the main scanning direction. That is, it is made to be such that the nozzles 51C and 51D do not deposit dots in the same positions as one another in the sub-scanning direction, as shown in FIG. 6C. As a result, ink is conferred over a sufficient area in the area P, and hence the visibility of streakiness can be reduced effectively from a microscopic view point.

FIGS. 7A, 7B and 7C show a case in which the landing positions of the dots deposited by the two nozzles 51C and 51D in the center are displaced in a direction toward one another in the main scanning direction. In this case, as in the case of FIGS. 6A, 6B and 6C, the landing position of each of the dots deposited by the nozzles 51C and 51D is displaced by a prescribed amount in the main scanning direction. In this case, if the correction is not carried out, then as shown in FIG. 7A, streakiness is seen in an area P1 between the dot rows 110B and 110C and an area P2 between the dot rows 110D and 110E. Moreover, with the correction method according to the related art, as shown in FIG. 7B, dots 120A and 120B are added, and instead, dots 122A and 122B are thinned out. In this case, as in the case of FIG. 6B, the state is such that there is little coloring material in the areas P1 and P2 from a microscopic viewpoint. On the other hand, according to the correction method of the present example of the invention, as shown in FIG. 7C, the nozzles 51C and 51D for which the landing positions are displaced by the prescribed amount in the main scanning direction are each made to deposit dots at high frequency so that the dots make contact with one another. Accordingly, flat dots 124 are formed, and hence sufficient coloring material is conferred in the areas P1 and P2. In this way, the visibility of streakiness can be reduced effectively even if the landing positions of the dots deposited by the adjacent nozzles 51C and 51D are displaced in a direction toward one another.

FIGS. 8A, 8B and 8C show a case in which only the landing positions of the dots deposited by the nozzle 51C are displaced, the displacement being toward the nozzle 51B. In this case, if the correction is not carried out, then as shown in FIG. 8A, streakiness is seen in the area P between the dot rows 110C and 110D. Moreover, with the correction method according to the related art, as shown in FIG. 8B, dots 120A, 120B, and 120C are added in the dot rows 110C and 110D in the vicinity of the streakiness, and instead, dots 122A, 122B, and 122C normally deposited in the dot rows 110B and 110E adjacent to the dot rows 110C and 110D are thinned out; however, the state is such that there is little coloring material in the area P. In contrast with this, with the correction method of the present invention, as shown in FIG. 8C, the nozzle 51C for which the landing positions are displaced by the prescribed amount in the main scanning direction, and also the nozzle 51D adjacent thereto on a side opposite to the direction in which the landing positions are displaced, are made to deposit dots at high frequency so that the dots make contact with one another. In this way, flat dots 124 are formed, so that the visibility of the streakiness is reduced effectively.

Figure 9:
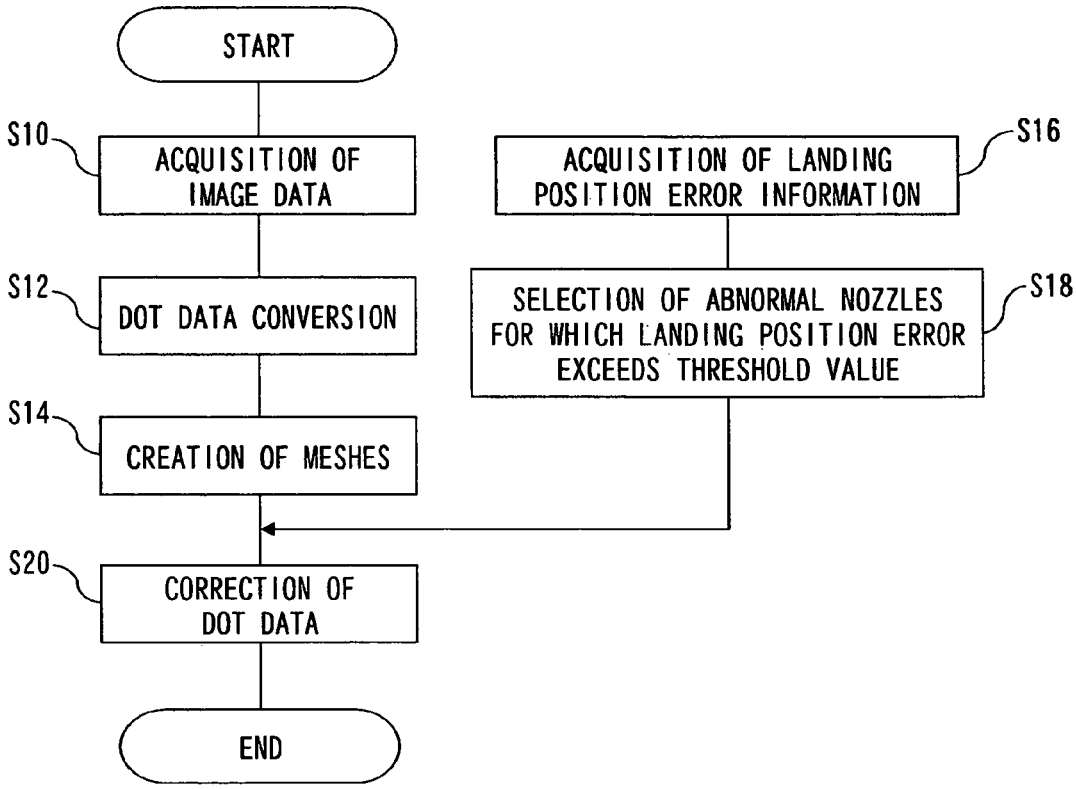
FIG. 9 is a flowchart showing the flow of deposition correction according to an embodiment of the present invention.

FIG. 9 is a flowchart showing the flow of deposition correction in an embodiment of the present invention. The processing shown in FIG. 9 is implemented by the print controller 80 shown in FIG. 4.

The print controller 80 first acquires the image data (step S10), and converts this image data into dot data on the basis of a known method (e.g., a dither method, or an error diffusion method) (step S12). Meshes which each have a predetermined size are then produced, and the dot data produced through the conversion is partitioned according to the meshes (step S14).

Moreover, the print controller 80 acquires data on landing position errors for dots deposited by the nozzles of the ink ejection heads (landing position error information) (step S16). In the present embodiment, errors in the main scanning direction of the landing position of the dots deposited by each of the nozzles are acquired. The timing of acquiring the landing position error information may be, for example, when the product is shipped out, when the power is turned on, or during printing; of course, a combination of these may also be used. The landing position error information for the nozzles is read by the print determination unit 26 described with reference to FIGS. 1 to 4, and sent to the print controller 80. For example, the results obtained by reading a line or solid image test print by means of the print determination unit 26 may be sent to the print controller 80. The print controller 80 carries out data analysis on the acquired landing position error information as required, and out of the nozzles, selects an abnormal nozzle for which the landing position error exceeds a predetermined threshold value (step S18).

Next, for the dot data that has been partitioned according to the meshes in step S14, the number of dots that would normally be deposited in each mesh by the abnormal nozzle selected in step S18 is counted, and the dot data for each mesh is corrected so that the abnormal nozzle continuously deposit at a high frequency a number of dots equal to the counted number (step S20). The ink ejection heads 12K, 12C, 12M, and 12Y are then driven on the basis of the corrected dot data.

According to the deposition correction described above, the number of dots deposited by the abnormal nozzle in each mesh does not change between before and after the correction, and hence the density of the image is the same before and after the correction from a macroscopic viewpoint. Considering the visibility, spacing between the meshes is preferably made to be approximately 100 to 200 m on a side. A method in which meshes are assigned only to areas for an abnormal nozzle(s) may also be used. Moreover, in FIG. 9, the dot data is corrected on the basis of the selected abnormal nozzle after the image data has been converted into the dot data; however, it may be made to be such that, when the image data is converted into dot data, the conversion is carried out on the basis of the incorporated data on an abnormal nozzle.

Description of Treatment Liquid and Inks (Ink Set)

In the present invention, as described above, in the case where the errors in the main scanning direction of the landing positions of dots formed by droplets ejected by a nozzle exceed a predetermined threshold value, correction is carried out so that the nozzle continuously deposits dots at a high frequency (i.e. with a short deposition interval) so as to form flat dots, and hence the visibility of streakiness is reduced. However, if the dots are deposited with a short deposition interval, then a phenomenon of the liquid droplets deposited on the recording medium uniting with one another (deposition interference) can occurs. Accordingly, in the inkjet recording apparatus 10 according to embodiments of the present invention, an ink set including a treatment liquid which contains a polymerization initiator, a diffusion preventing agent, and an oil (high-boiling solvent), and various colored inks each of which contains a polymerizable compound, and a coloring material, is used. The treatment liquid is deposited onto the recording medium prior to the colored inks, whereby deposition interference is prevented through the effects of the treatment liquid, and hence the visibility of streakiness can be reduced with no degradation in image quality. Following is a detailed description of the ink set used in the present invention.

Polymerizable Compounds (Radiation-Curable Monomers and Oligomers)

"Polymerizable compound" refers to a compound that has a capability of undergoing polymerization and hence curing through the action of initiating species such as radicals generated from a polymerization initiator, described below.

Each polymerizable compound is preferably an addition polymerization-undergoing compound having at least one ethylenic unsaturated double bond therein, and is preferably selected from polyfunctional compounds having at least one terminal ethylenic unsaturated bond, more preferably at least two terminal ethylenic unsaturated bonds, therein. The group of such compounds is widely known in the industrial field in question, and these compounds can be used with no particular limitations thereon. These compounds include, for example, ones having chemical forms such as monomers, and prepolymers, i.e. dimers, trimers and other oligomers, and mixtures or copolymers thereof.

The polymerizable compound preferably has a polymerizable group such as an acryloyl group, a methacryloyl group, an allyl group, a vinyl group, or an internal double bond group (maleic acid etc.) in the molecule thereof. Of these, a compound having an acryloyl group or a methacryloyl group is preferable since the curing reaction can be brought about with little energy.

In each liquid, one polymerizable compound only may be used, or a plurality of polymerizable compounds may be used in combination.

The polymerizable compound content in the first liquid containing colorant is preferably in a range of 50 to 99% by mass, more preferably 70 to 99% by mass, yet more preferably 80 to 99% by mass, of the first liquid.

Polymerization Initiators (Curing Initiators, Reaction Initiators)

"Polymerization initiator" refers to a compound that generates initiating species such as radicals through light, or heat, or both of these types of energy, thus initiating and promoting the polymerization of the polymerizable compound(s). A publicly known thermal polymerization initiator, a compound having therein a bond with low bond dissociation energy, a photopolymerization initiator, or the like can be selected and used.

Examples of such radical generating agents include halogenated organic compounds, carbonyl compounds, organic peroxide compounds, azo type polymerization initiators, azide compounds, metallocene compounds, hexaarylbiimidazole compounds, organic borate compounds, disulfonic acid compounds, and onium salt compounds.

In the ink set of an embodiment the present invention, a polymerization initiator that cures the polymerizable compound(s) is contained in at least one of the plurality of liquids used.

From the viewpoint of stability over time, curability and curing rate, the polymerization initiator content is preferably 0.5 to 20% by mass, more preferably 1 to 15% by mass, yet more preferably 3 to 10% by mass, relative to all of the polymerizable compounds used in the ink set.

One polymerization initiator may be used, or a plurality of polymerization initiators may be used in combination. Moreover, so long as there is no impairment of the effects of the present invention, the polymerization initiator(s) may be used together with a publicly known sensitizer with an object of improving the sensitivity.

Colorants (Coloring Materials)

There are no particular limitations on the colorants used in an embodiment of the present invention. So long as these colorants are such that a hue and color density suitable for the ink usage can be attained, ones selected as appropriate from publicly known water-soluble dyes, oil-soluble dyes and pigments can be used. Of these, from the viewpoint of ink droplet ejection stability and quick drying ability, the liquids constituting the inkjet recording inks in the present invention are preferably water-insoluble liquids not containing an aqueous solvent. From this viewpoint, it is preferable to use an oil-soluble dye or pigment that readily disperses or dissolves uniformly in the water-insoluble liquid.

There are no particular limitations on oil-soluble dyes that can be used in the present invention, with it being possible to use one chosen as desired. The dye content in the case of using an oil-soluble dye as a colorant is preferably in a range of 0.05 to 20% by mass, more preferably 0.1 to 15% by mass, particularly preferably 0.2 to 6% by mass, in terms of solid content.

A mode in which a pigment is used as a colorant is preferable from the viewpoint of aggregation readily occurring when the plurality of liquids are mixed together.

As pigments that can be used in the present invention, either organic pigments or inorganic pigments can be used. A carbon black pigment is preferable as a black pigment. In general, a black pigment, and pigments of the three primary colors, cyan, magenta and yellow, are used; however, pigments having other hues, for example red, green, blue, brown or white pigments, pigments having a metallic luster such as gold or silver pigments, uncolored or light body pigments, and so on may also be used in accordance with the object.

Moreover, particles obtained by fixing a dye or a pigment to the surface of a core material made of silica, alumina, a resin or the like, an insoluble lake pigment obtained from a dye, a colored emulsion, a colored latex, or the like may also be used as a pigment.

Furthermore, a resin-coated pigment may also be used. Such a resin-coated pigment is known as a "microcapsule pigment", and is commercially available from manufacturers such as Dainippon Ink and Chemicals Inc. and Toyo Ink Mfg. Co., Ltd.

From the viewpoint of the balance between the optical density and the storage stability, the volume average particle diameter of the pigment particles contained in a liquid in the present invention is preferably in a range of 30 to 250 nm, more preferably 50 to 200 nm. Here, the volume average particle diameter of the pigment particles can be measured, for example, using a measuring apparatus such as an LB-500 (made by HORIBA Ltd.).

From the viewpoint of the optical density and the ejection stability, the pigment content in the case of using a pigment as a colorant is preferably in a range of 0.1 to 20% by mass, more preferably 1 to 10% by mass, in terms of solid content in each first liquid.

One colorant only may be used, or a plurality of colorants may be used mixed together. Moreover, different colorants, or the same colorants, may be used in each of the liquids.

Diffusion Preventing Agents (Polymers)

In an embodiment of the present invention, "diffusion preventing agent" refers to a substance contained in the second liquid with an object of preventing diffusion and smearing of the colorant-containing first liquids of which droplets are deposited onto the second liquid that has been put onto the recording medium.

As such a diffusion preventing agent, there is contained at least one selected from the group of polymers having an amino group, polymers having an onium group, polymers having a nitrogen-containing hetero ring, and metal compounds.

One of the above polymers or the like may be used, or a plurality may be used in combination. "Plurality" includes both, for example, the case of polymers that are polymers having an amino group but have different structures to one another, and the case of different types such as a polymer having an amino group and a polymer having an onium group. Moreover, a combination selected from amino groups, onium groups, nitrogen-containing hetero rings, and metal compounds may be present together in one molecule.

Following is a detailed description of these polymers and so on.

Polymers Having an Amino Group

A homopolymer of an only monomer having an amino group, or a copolymer of a monomer of an amino group and another monomer may be used as a polymer having an amino group. The "monomer having an amino group" content in the polymer having an amino group is preferably not less than 10 mol % but not more than 100 mol %, more preferably not less than 20 mol % but not more than 100 mol %.

Examples of monomers having an amino group include N,N-dimethylaminoethyl(meth)acrylate, N,N-diethylaminoethyl(meth)acrylate, N,N-dimethylaminopropyl(meth)acrylate, N,N-diethylaminopropyl(meth)acrylate, N,N-dimethylaminoethyl(meth)acrylamide, N,N-diethylaminoethyl(meth)acrylamide, N,N-dimethylaminopropyl(meth)acrylamide, N,N-diethylaminopropyl(meth)acrylamide, diallylamine, N-methyldiallylamine, N-vinylbenzyl-N,N-dimethylamine, N-vinylbenzyl-N,N-diethylamine, N-vinylbenzyl-N-ethyl-N-methylamine, N-vinylbenzyl-N,N-dihexylamine, N-vinylbenzyl-N-octadecyl-N-methylamine, N-vinylbenzyl-N'-methyl-piperazine, N-vinylbenzyl-N'-(2-hydroxyethyl)-piperazine, N-benzyl-N-methylaminoethyl(meth)acrylate, and N,N-dibenzylaminoethyl(meth)acrylate.

Of these, N,N-dimethylaminoethyl(meth)acrylate, N,N-diethylaminoethyl(meth)acrylate, N,N-dimethylaminopropyl(meth)acrylate, N,N-diethylaminopropyl(meth)acrylate, N,N-dimethylaminoethyl(meth)acrylamide, N,N-diethylaminoethyl(meth)acrylamide, N,N-dimethylaminopropyl(meth)acrylamide, and N,N-diethylaminopropyl(meth)acrylamide are more preferable, with N,N-dimethylaminoethyl(meth)acrylate, N,N-diethylaminoethyl(meth)acrylate, and N,N-dimethylaminopropyl(meth)acrylamide being particularly preferable.

Examples of monomers that can be copolymerized with these monomers include (meth)acrylic acid alkyl esters (e.g. (meth)acrylic acid alkyl esters having 1 to 18 carbon atoms in the alkyl part thereof such as methyl(meth)acrylate, ethyl(meth)acrylate, propyl(meth)acrylate, isopropyl(meth)acrylate, n-butyl(meth)acrylate, isobutyl(meth)acrylate, t-butyl(meth)acrylate, hexyl(meth)acrylate, octyl(meth)acrylate, 2-ethylhexyl(meth)acrylate, lauryl(meth)acrylate, and stearyl(meth)acrylate), (meth)acrylic acid cycloalkyl esters (e.g. cyclohexyl(meth)acrylate, etc.), (meth)acrylic acid aryl esters (e.g. phenyl(meth)acrylate, etc.), (meth)acrylic acid aralkyl esters (e.g. benzyl(meth)acrylate, etc.), substituted (meth)acrylic acid alkyl esters (e.g. 2-hydroxyethyl(meth)acrylate, etc.), (meth)acrylamides (e.g. (meth)acrylamide, dimethyl(meth)acrylamide, etc.), aromatic vinyl compounds (e.g. styrene, vinyltoluene, α-methylstyrene, etc.), vinyl esters (e.g. vinyl acetate, vinyl propionate, vinyl versatate, etc.), allyl esters (e.g. allyl acetate, etc.), halogen-containing monomers (e.g. vinylidene chloride, vinyl chloride, etc.), vinyl cyanides (e.g. (meth)acrylonitrile, etc.), and olefins (e.g. ethylene, propylene, etc.).

Of these copolymerizable monomers, (meth)acrylic acid alkyl esters having an alkyl group having 1 to 8 carbon atoms, benzyl(meth)acrylate, and styrene are preferable, with ethyl(meth)acrylate, propyl(meth)acrylate, n-butyl(meth)acrylate, n-hexyl(meth)acrylate, and 2-ethylhexyl(meth)acrylate being particularly preferable.

Furthermore, other polymers having an amino group include polyallylamine, polyvinylamine, polyethyleneimine, polydiallylamine, poly(N-methyldiallylamine), poly(N-ethyldiallylamine), and modified compounds thereof (a benzyl chloride adduct, a phenyl glycidyl ether adduct, and an acrylonitrile adduct of polyallylamine), and polyadducts between a diisocyanate (e.g. hexamethylene diisocyanate, isophorone diisocyanate, toluene diisocyanate, or xylylene diisocyanate)

and a diol having a tertiary amino group (e.g. N-methyldiethanolamine, N-ethyldiethanolamine, or N,N'-3-hydroxypropylpiperazine).

Of these, polyallylamine, polyvinylamine, polyethyleneimine, and modified compounds thereof are preferable, with a modified compound of polyallylamine being particularly preferable.

In the present invention, as a polymer having an amino group, a polymer having therein a unit represented by the following general formula (1) is particularly preferable.

(General Formula 1)

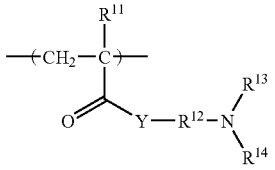

In general formula (1), $R^{11}$ represents hydrogen or a methyl group, Y represents O or $NR^{15}$, $R^{15}$ represents hydrogen or an alkyl group, $R^{12}$ represents a bivalent connecting group, and $R^{13}$ and $R^{14}$ each independently represents an alkyl group, an aralkyl group, or an aryl group.

Hydrogen is more preferable as $R^{11}$, O or NH is more preferable as Y, with O being yet more preferable, and an alkyl group or an aralkyl group is more preferable as each of $R^{13}$ and $R^{14}$, with an alkyl group being yet more preferable.

As the bivalent connecting group represented by $R^{12}$, an alkylene group or an arylene group is preferable, with an alkylene group being more preferable.

Specific examples of the bivalent connecting group include a methylene group, an ethylene group, a propylene group, a trimethylene group, a tetramethylene group, a hexamethylene group, an octamethylene group, a phenylene group, and a 2-hydroxypropylene group. Of these, an ethylene group, a propylene group, and a trimethylene group are preferable.

As an alkyl group represented by $R^{13}$, $R^{14}$ or $R^{15}$, an alkyl group having not more than 18 carbon atoms is preferable, with an alkyl group having not more than 12 carbon atoms being more preferable, and an alkyl group having not more than 8 carbon atoms being particularly preferable. The alkyl group may be straight chain, or cyclic, and may have substituents, examples of the substituents including a hydroxy group, alkoxy groups (e.g. a methoxy group, an ethoxy group, a propoxy group, etc.), aryloxy groups (e.g. a phenoxy group, etc.), amino groups, carbamoyl groups, and halogen atoms.

Specific examples of such (substituted) alkyl groups include a methyl group, an ethyl group, an n-propyl group, an isopropyl group, an n-butyl group, an isobutyl group, a t-butyl group, an n-hexyl group, a cyclohexyl group, a 2-ethylhexyl group, an n-octyl group, an n-nonyl group, an n-decyl group, an n-dodecyl group, an n-octadecyl group, a hydroxyethyl group, a 1-hydroxypropyl group, an N,N-dimethylaminoethyl group, a methoxyethyl group, and a chloroethyl group. Of these, a methyl group, an ethyl group, an n-propyl group, an isopropyl group, an n-butyl group, an isobutyl group, a t-butyl group, an n-hexyl group, a cyclohexyl group, a 2-ethylhexyl group, an n-octyl group, an n-nonyl group, and an n-decyl group are more preferable, with a methyl group, an ethyl group, an n-propyl group, an n-butyl group, and an n-hexyl group being particularly preferable.

As an aryl group represented by $R^{13}$ or $R^{14}$, an aryl group having not more than 18 carbon atoms is preferable, with an aryl group having not more than 16 carbon atoms being more preferable, and an aryl group having not more than 12 carbon atoms being particularly preferable. Moreover, the aryl group may have substituents.

Specific examples of such (substituted) aryl groups include a phenyl group, alkylphenyl groups (e.g. a methylphenyl group, an ethylphenyl group, an n-propylphenyl group, an n-butylphenyl group, a cumenyl group, a mesityl group, a tolyl group, a xylyl group, etc.), a naphthyl group, a chlorophenyl group, a dichlorophenyl group, a trichlorophenyl group, a bromophenyl group, a hydroxyphenyl group, a methoxyphenyl group, an acetoxyphenyl group, and a cyanophenyl group. Of these, a phenyl group and a naphthyl group are particularly preferable.

As an aralkyl group represented by $R^{13}$ or $R^{14}$, an aralkyl group having not more than 18 carbon atoms is preferable, with an aralkyl group having not more than 16 carbon atoms being more preferable, and an aralkyl group having not more than 12 carbon atoms being particularly preferable. Examples of the alkyl part of the aralkyl group are alkyl groups as above, and examples of the aryl part of the aralkyl group are aryl groups as above. Moreover, the aralkyl group may have substituents.

Specific examples of such (substituted) aralkyl groups include a benzyl group, a phenylethyl group, a vinylbenzyl group, a hydroxyphenylmethyl group, a diphenylmethyl group, a trityl group, and a styryl group. Of these, a benzyl group is particularly preferable.

Preferable specific examples of polymers having units represented by the general formula (1) are as follows.

P1-1

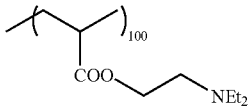

P1-2

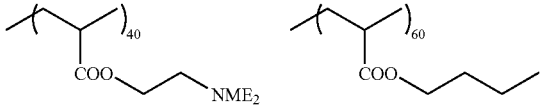

P1-3

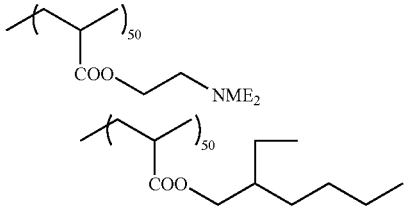

P1-4

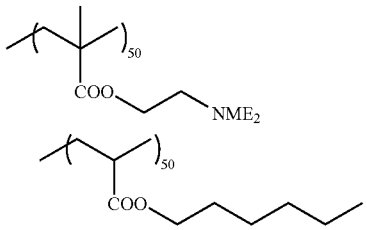

P1-5

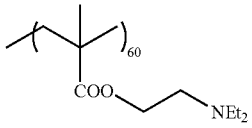

-continued

P1-6

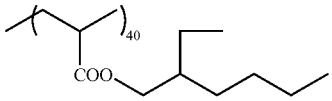

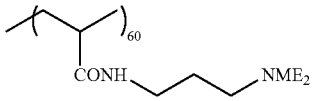

P1-7

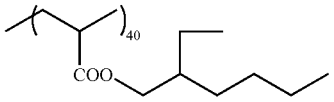

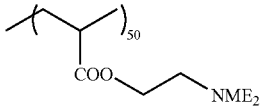

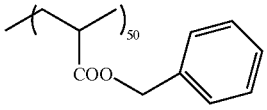

P1-8

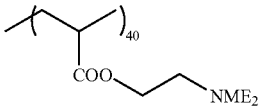

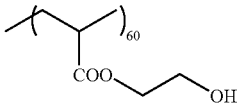

P1-9

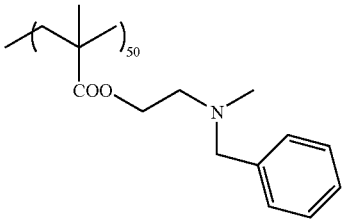

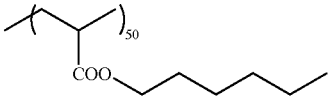

P1-10

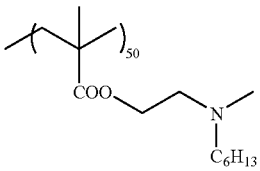

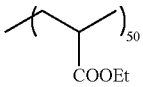

P1-11

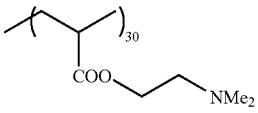

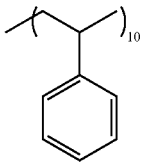

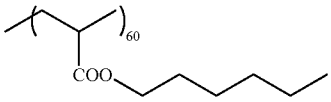

P1-12

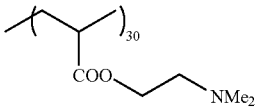

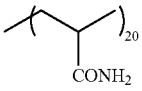

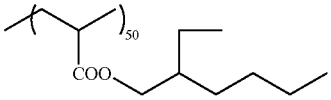

-continued

P1-13

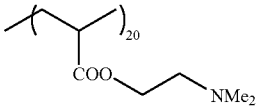

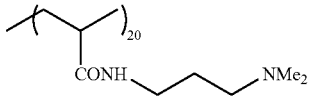

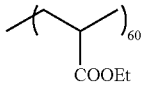

P1-14

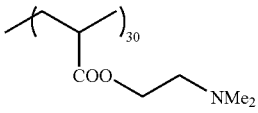

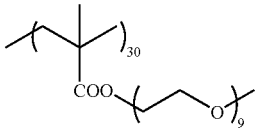

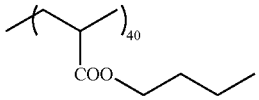

Preferable polymers having an amino group according to the present invention other than polymers having units represented by general formula (1) are as follows.

P1-15

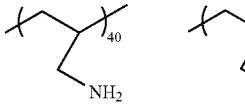

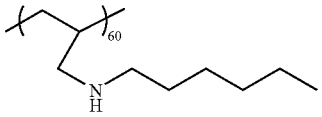

P1-16

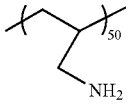

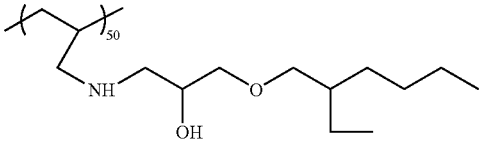

P1-17

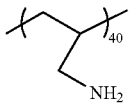

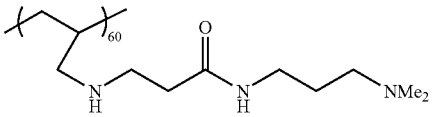

P1-18

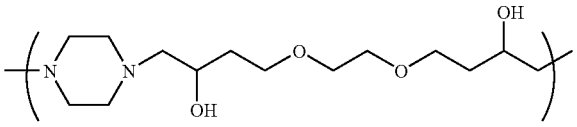

A polymer having therein a unit represented by general formula (1) can be synthesized using radical (co)polymerization. As the radical (co)polymerization, for example, a publicly known method such as bulk polymerization, solution polymerization, or emulsion polymerization can be used. However, there is no limitation to such a method, with it also being possible to use another publicly known method.

The weight average molecular weight of a polymer having an amino group used in the present invention is preferably in a range of 1000 to 50000, particularly preferably 2000 to 30000.

It is preferable for such a polymer having an amino group to be contained in at least one liquid not containing a colorant. The amount used of the polymer having an amino group in the present invention is preferably in a range of 1 to 90% by mass, more preferably 10 to 75% by mass, particularly preferably 20 to 50% by mass, relative to all of each liquid. If the amount used is less than this, then it may not be possible to realize the effects of the present invention effectively, whereas if the amount used is greater than this, then the viscosity may become high, and hence problems with the ink ejectability may arise.

Polymers Having an Onium Group

A polymer having an onium group may be a homopolymer of only a monomer having an onium group, or a copolymer of a monomer having an onium group and another monomer. The "monomer having an onium group" content in the polymer having an onium group is preferably not less than 10 mol %, more preferably not less than 20 mol %.

Examples of the onium group are an ammonium group, a phosphonium group, and a sulfonium group, with an ammonium group being preferable. A polymer having an ammonium group can be obtained as a homopolymer of a monomer having a quaternary ammonium salt group, or a copolymer or a condensation polymer between a monomer having a quaternary ammonium salt group and another monomer.

In the present invention, as a polymer having an ammonium group, a polymer having therein at least a unit represented by the following general formula (2) or (3) is particularly preferable.

(GENERAL FORMULA 2)

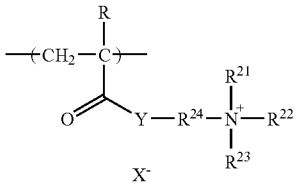

(GENERAL FORMULA 3)

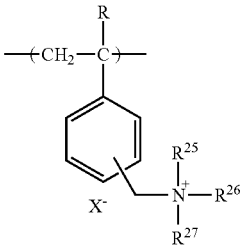

In the formulae, R represents a hydrogen atom or a methyl group, and $R^{21}$ to $R^{23}$ and $R^{25}$ to $R^{27}$ each independently represent an alkyl group, an aralkyl group, or an aryl group. $R^{24}$ represents an alkylene group, an aralkylene group, or an arylene group. Y represents O or NR', and R' represents a hydrogen atom or an alkyl group. $X^-$ represents a counter anion.

As an alkyl group represented by one of $R^{21}$ to $R^{23}$ and $R^{25}$ to $R^{27}$, an alkyl group having not more than 18 carbon atoms is preferable, with an alkyl group having not more than 16 carbon atoms being more preferable, and an alkyl group having not more than 12 carbon atoms being particularly preferable. The alkyl group may be straight chain, or cyclic, and may have substituents, examples of the substituents including alkoxy groups, aryloxy groups, halogen atoms, a hydroxyl group, carbamoyl groups, and amino groups.

Specific examples of such (substituted) alkyl groups include a methyl group, an ethyl group, an n-propyl group, an isopropyl group, an n-butyl group, an isobutyl group, a t-butyl group, an n-hexyl group, a cyclohexyl group, a 2-ethylhexyl group, an n-octyl group, an n-nonyl group, an n-decyl group, an n-dodecyl group, an n-octadecyl group, a hydroxyethyl group, a 1-hydroxypropyl group, an N,N-dimethylaminoethyl group, a methoxyethyl group, and a chloroethyl group.

Of these alkyl groups, a methyl group, an ethyl group, an n-propyl group, an isopropyl group, an n-butyl group, an isobutyl group, a t-butyl group, an n-hexyl group, a cyclohexyl group, a 2-ethylhexyl group, an n-octyl group, an n-nonyl group, and an n-decyl group are more preferable, with a methyl group, an ethyl group, an n-propyl group, an n-butyl group, and an n-hexyl group being particularly preferable.

As an aryl group represented by one of $R^{21}$ to $R^{23}$ and $R^{25}$ to $R^{27}$, an aryl group having not more than 18 carbon atoms is preferable, with an aryl group having not more than 16 carbon atoms being more preferable, and an aryl group having not more than 12 carbon atoms being particularly preferable. Moreover, the aryl group may have substituents, examples of the substituents including alkyl groups, alkoxy groups, aryloxy groups, halogen atoms, a hydroxyl group, carbamoyl groups, a cyano group, and amino groups.

Specific examples of such (substituted) aryl groups include a phenyl group, alkylphenyl groups (e.g. a methylphenyl group, an ethylphenyl group, an n-propylphenyl group, an n-butylphenyl group, a cumenyl group, a mesityl group, a tolyl group, a xylyl group, etc.), a naphthyl group, a chlorophenyl group, a dichlorophenyl group, a trichlorophenyl group, a bromophenyl group, a hydroxyphenyl group, a methoxyphenyl group, an acetoxyphenyl group, and a cyanophenyl group.

Of these (substituted) aryl groups, a phenyl group and a naphthyl group are particularly preferable.

As an aralkyl group represented by one of $R^{21}$ to $R^{23}$ and $R^{25}$ to $R^{27}$, an aralkyl group having not more than 18 carbon atoms is preferable, with an aralkyl group having not more than 16 carbon atoms being more preferable, and an aralkyl group having not more than 12 carbon atoms being particularly preferable. Examples of the alkyl part of the aralkyl group are alkyl groups as above, and examples of the aryl part of the aralkyl group are aryl groups as above. The alkyl part and/or the aryl part of the aralkyl group may have substituents, examples of the substituents being as given above for the alkyl group and the aryl group.

Specific examples of such (substituted) aralkyl groups include a benzyl group, a phenylethyl group, a vinylbenzyl group, a hydroxyphenylmethyl group, a diphenylmethyl group, a trityl group, and a styryl group.

Of these (substituted) aralkyl groups, a benzyl group is particularly preferable.

It is particularly preferable for each of $R^{21}$ to $R^{23}$ and $R^{25}$ to $R^{27}$ to be independently an alkyl group or an aralkyl group. Of these, a methyl group, an ethyl group, a hexyl group, and a benzyl group are particularly preferable.

$R^{24}$ represents a bivalent connecting group, preferably an alkylene group, an aralkylene group, or an arylene group.

An alkylene group represented by $R^{24}$ preferably has not more than 8 carbon atoms, more preferably not more than 6 carbon atoms, particularly preferably not more than 4 carbon atoms. The alkylene group may be straight chain, or cyclic, and may have substituents, examples of the substituents including alkoxy groups, aryloxy groups, halogen atoms, a hydroxyl group, carbamoyl groups, and amino groups.

Specific examples of such (substituted) alkylene groups include a methylene group, an ethylene group, a propylene group, a trimethylene group, a tetramethylene group, a hexamethylene group, an octamethylene group, a 2-hydroxyethylene group, a 2-hydroxypropylene group, and a 2-methoxypropylene group.

Of these (substituted) alkylene groups, a methylene group, an ethylene group, a propylene group, a trimethylene group, and a 2-hydroxypropylene group are preferable.

An arylene group represented by $R^{24}$ preferably has not more than 12 carbon atoms, more preferably not more than 10 carbon atoms, particularly preferably not more than 8 carbon atoms. The arylene group may have substituents, examples of the substituents being as given above for the aryl group.

Specific examples of such (substituted) arylene groups include a phenylene group, alkylphenylene groups (e.g. a 2-ethyl-1,4-phenylene group, a 2-propyl-1,4-phenylene group, etc.), a 2-chloro-1,4-phenylene group, and alkoxyphenylene groups (e.g. a 2-methoxy-1,4-phenylene group, etc.). Of these, a phenylene group is particularly preferable.

An aralkylene group represented by $R^{24}$ preferably has not more than 12 carbon atoms, more preferably not more than 10 carbon atoms, particularly preferably not more than 8 carbon atoms. Examples of the alkyl part of the aralkylene group are alkyl group as above, and examples of the aryl part of the aralkylene group are aryl groups as above. The aralkylene group may have substituents, examples of the substituents being as given above for the alkyl group and the aryl group.

Specific examples of such (substituted) aralkylene groups include a xylylene group and a benzylidene group, with a benzylidene group being particularly preferable.

It is particularly preferable for $R^{24}$ to be alkylene group, with an ethylene group or a propylene group being more preferable.

As an alkyl group represented by R', those given above as alkyl groups for $R^{21}$ to $R^{23}$ and $R^{25}$ to $R^{27}$ are preferable. Preferable specific examples are also as for $R^{21}$ to $R^{23}$ and $R^{25}$ to $R^{27}$.

"—Y—" is particularly preferably "—O—" or "—NH—".

$X^-$ is a counter anion, examples including a halide ion ($Cl^-$, $Br^-$, $I^-$), a sulfonate ion, alkylsulfonate ions, arylsulfonate ions, alkylcarboxylate ions, arylcarboxylate ions, $PF_6^-$, and $BF_4^-$. Of these, $Cl^-$, $Br^-$, a toluenesulfonate ion, a methanesulfonate ion, $PF_6^-$, and $BF_4^-$ are particularly preferable.

In the case of a polymer having therein a unit represented by general formula (2) or (3), the content of the unit represented by general formula (2) or (3) in the polymer is preferably in a range of 10 to 100 mol %, more preferably 20 to 100 mol %.

Preferable specific examples of polymers having units represented by general formula (2) or (3) are as follows.

P2-1

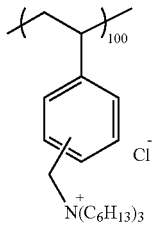

P2-2

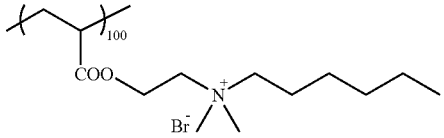

P2-3

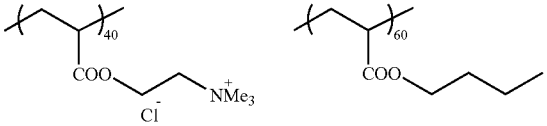

P2-4

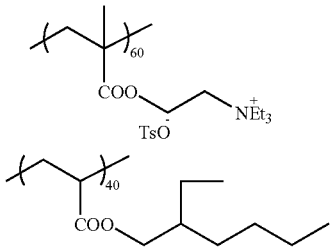

P2-5

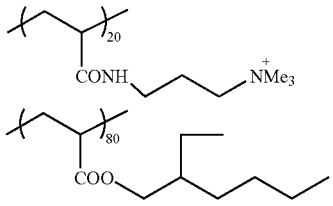

P2-6

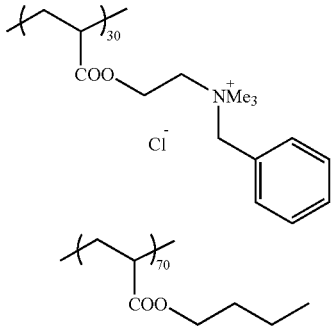

P2-7

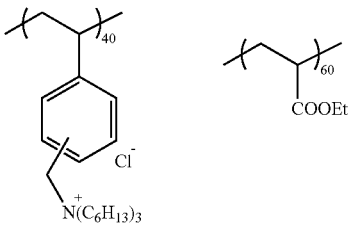

-continued

P2-8

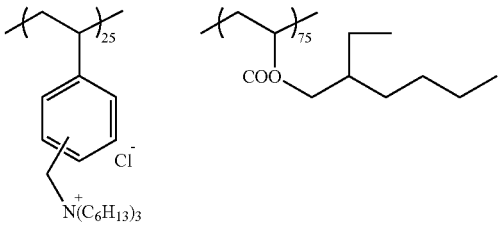

P2-9

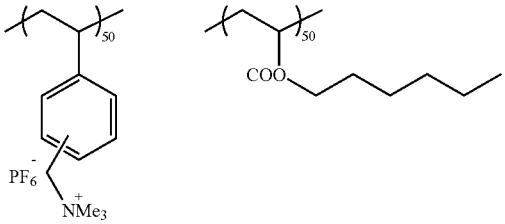

P2-10

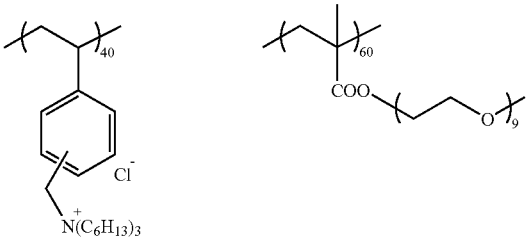

P2-11

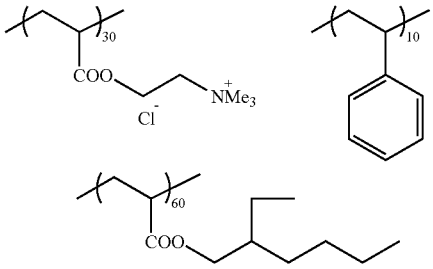

P2-12

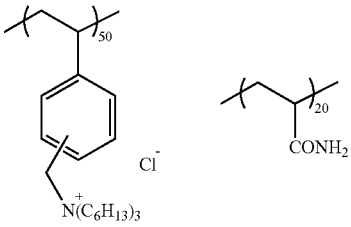

P2-13

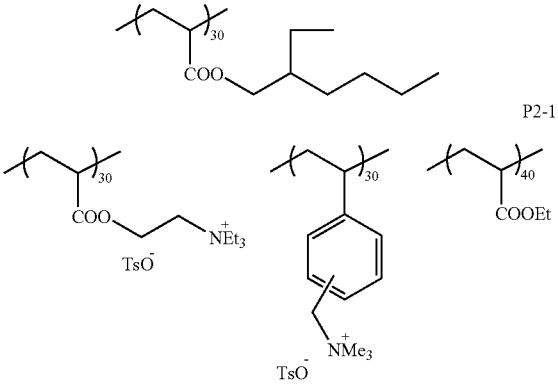

Examples of polymers having an onium group according to the present invention other than polymers having units represented by general formula (2) or (3) include epichlorohydrin-dimethylamine addition polymers, and addition polymers between a dihalide compound (e.g. xylylene dichloride, xylylene dibromide, 1,6-dibromohexane) and a diamine (N,N,N',N'-tetramethylethylenediamine, N,N,N',N'-tetramethylhexamethylenediamine, N,N'-dimethylpiperazine, diazobicyclooctane).

A polymer having an amino group (e.g. polyallylamine, polyvinylamine, polyethyleneimine, polydiallylamine, poly(N-methyldiallylamine), poly(N-ethyldiallylamine), a polyadduct between a diisocyanate (e.g. hexamethylene diisocyanate, isophorone diisocyanate, toluene diisocyanate, xylylene diisocyanate) and a diol having a tertiary amino group (e.g. N-methyldiethanolamine, N-ethyldiethanolamine, N,N'-3-hydroxypropylpiperazine), etc.) can also be obtained by adding methyl chloride, ethyl chloride, methyl bromide, ethyl bromide, methyl iodide, ethyl iodide, dimethyl sulfate, diethyl sulfate, methyl p-toluenesulfonate, or ethyl p-toluenesulfonate.

Of these, specific examples of preferable polymers are as follows.

P2-14

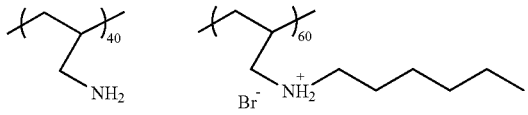

P2-15

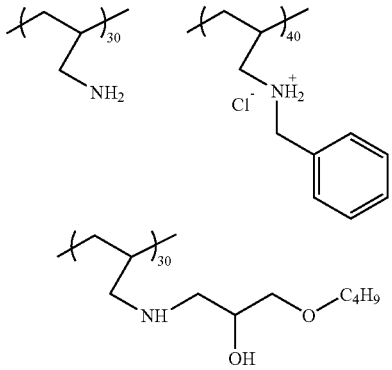

P2-16

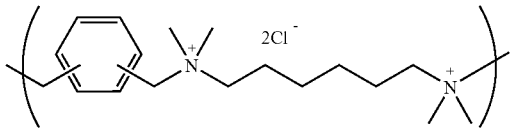

P2-17

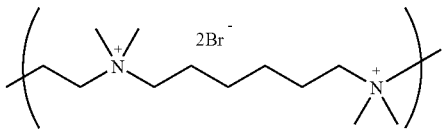

A polymer having a unit represented by general formula (2) or (3) can be obtained as a homopolymer of an undermentioned monomer having an ammonium group or a copolymer containing such a monomer.

Examples of the monomer having an ammonium group include trimethyl-p-vinylbenzyl ammonium chloride, trimethyl-m-vinylbenzyl ammonium chloride, triethyl-p-vinylbenzyl ammonium chloride, triethyl-m-vinylbenzyl ammonium chloride, N,N-dimethyl-N-ethyl-N-p-vinylbenzyl ammonium chloride, N,N-diethyl-N-methyl-N-p-vinylbenzyl ammonium chloride, N,N-dimethyl-N-n-propyl-N-p-vinylbenzyl ammonium chloride, N,N-dimethyl-N-n-octyl-N-p-vinylbenzyl ammonium chloride, N,N-dimethyl-N-benzyl-N-p-vinylbenzyl ammonium chloride, N,N-diethyl-N-benzyl-N-p-vinylbenzyl ammonium chloride, N,N-dimethyl-N-(4-methyl)benzyl-N-p-vinylbenzyl ammonium chloride, N,N-dimethyl-N-phenyl-N-p-vinylbenzyl ammonium chloride, trimethyl-p-vinylbenzyl ammonium bromide, trimethyl-m-vinylbenzyl ammonium bromide, trimethyl-p-vinylbenzyl ammonium sulfonate, trimethyl-m-vinylbenzyl ammonium sulfonate, trimethyl-p-vinylbenzyl ammonium acetate, trimethyl-m-vinylbenzyl ammonium acetate, N,N,N-triethyl-N-2-(4-vinylphenyl)ethyl ammonium chloride, N,N,N-triethyl-N-2-(3-vinylphenyl)ethyl ammonium chloride, N,N-diethyl-N-methyl-N-2-(4-vinylphenyl)ethyl ammonium chloride, N,N-diethyl-N-methyl-N-2-(4-vinylphenyl)ethyl ammonium acetate, trimethyl-2-(methacryloyloxy)ethyl ammonium chloride, triethyl-2-(methacryloyloxy)ethyl ammonium chloride, trimethyl-2-(acryloyloxy) ethyl ammonium chloride, triethyl-2-(acryloyloxy)ethyl ammonium chloride, trimethyl-3-(methacryloyloxy)propyl ammonium chloride, triethyl-3-(methacryloyloxy)propyl ammonium chloride, trimethyl-2-(methacryloylamino)ethyl ammonium chloride, triethyl-2-(methacryloylamino)ethyl ammonium chloride, trimethyl-2-(acryloylamino)ethyl ammonium chloride, triethyl-2-(acryloylamino)ethyl ammonium chloride, trimethyl-3-(methacryloylamino)propyl ammonium chloride, triethyl-3-(methacryloylamino)propyl ammonium chloride, trimethyl-3-(acryloylamino)propyl ammonium chloride, triethyl-3-(acryloylamino)propyl ammonium chloride, N,N-dimethyl-N-ethyl-2-(methacryloyloxy)ethyl ammonium chloride, N,N-diethyl-N-methyl-2-(methacryloyloxy)ethyl ammonium chloride, N,N-dimethyl-N-ethyl-3-(acryloylamino)propyl ammonium chloride, trimethyl-2-(methacryloyloxy)ethyl ammonium bromide, trimethyl-3-(acryloylamino)propyl ammonium bromide, trimethyl-2-(methacryloyloxy)ethyl ammonium sulfonate, trimethyl-3-(acryloylamino)propyl ammonium acetate, monomethyldiallyl ammonium chloride, dimethyldiallyl ammonium chloride, and allylamine hydrochloride.

Examples of monomers that can be copolymerized with these monomers include (meth)acrylic acid alkyl esters (e.g. C1-18 alkyl esters of (meth)acrylic acid such as methyl(meth) acrylate, ethyl(meth)acrylate, propyl(meth)acrylate, isopropyl(meth)acrylate, n-butyl(meth)acrylate, isobutyl(meth) acrylate, t-butyl(meth)acrylate, hexyl(meth)acrylate, octyl (meth)acrylate, 2-ethylhexyl(meth)acrylate, lauryl(meth) acrylate, and stearyl(meth)acrylate), (meth)acrylic acid cycloalkyl esters (e.g. cyclohexyl(meth)acrylate, etc.), (meth)acrylic acid aryl esters (e.g. phenyl(meth)acrylate, etc.), aralkyl esters (e.g. benzyl(meth)acrylate, etc.), substituted (meth)acrylic acid alkyl esters (e.g. 2-hydroxyethyl (meth)acrylate, etc.), (meth)acrylamides (e.g. (meth)acrylamide, dimethyl(meth)acrylamide, etc.), aromatic vinyl compounds (e.g. styrene, vinyltoluene, α-methylstyrene, etc.), vinyl esters (e.g. vinyl acetate, vinyl propionate, vinyl versatate, etc.), allyl esters (e.g. allyl acetate, etc.), halogen-containing monomers (e.g. vinylidene chloride, vinyl chloride, etc.), vinyl cyanides (e.g. (meth)acrylonitrile, etc.), and olefins (e.g. ethylene, propylene, etc.).

Of these copolymerizable monomers, (meth)acrylic acid alkyl esters, (meth)acrylamides, and aromatic vinyl compounds are preferable, with methyl(meth)acrylate, ethyl (meth)acrylate, propyl(meth)acrylate, isopropyl(meth)acrylate, n-butyl(meth)acrylate, isobutyl(meth)acrylate, t-butyl (meth)acrylate, hexyl(meth)acrylate, octyl(meth)acrylate, 2-ethylhexyl(meth)acrylate, 2-hydroxyethyl(meth)acrylate, and styrene being particularly preferable.

A polymer as above can be synthesized through radical (co)polymerization of the monomer(s). As the radical polymerization, a publicly known method such as bulk polymerization, solution polymerization, or emulsion polymerization can be used. Moreover, a polymerization initiating catalyst well known to persons skilled in the art can be used as required.

The weight average molecular weight of a polymer having an onium group used in the present invention is preferably not less than 1000 but not more than 50000, particularly preferably not less than 2000 but not more than 30000.

The amount used of the polymer having an onium group in the present invention is preferably in a range of 1 to 90% by mass, more preferably 10 to 75% by mass, particularly preferably 20 to 50% by mass, relative to all of each liquid. If the amount used is less than this, then it may not be possible to achieve the effects of the present invention effectively, whereas if the amount used is greater than this, then the viscosity may become high, and hence problems with the ink ejectability may arise.

Polymers Having a Nitrogen-Containing Hetero Ring

A polymer having a nitrogen-containing hetero ring may be a homopolymer of only a monomer having a nitrogen-containing hetero ring, or a copolymer of a monomer having a nitrogen-containing hetero ring and another monomer. The "monomer having a nitrogen-containing hetero ring" content in the polymer having a nitrogen-containing hetero ring is preferably at least 10 mol %, more preferably at least 20 mol %.

Here, specific examples of the nitrogen-containing hetero ring include saturated hetero rings (e.g. aziridine, azetidine, pyrrolidone, piperidine, piperazine, morpholine, thiomorpholine, caprolactam, valerolactam), and unsaturated hetero rings (e.g. imidazole, pyridine, pyrrole, pyrazole, pyrazine, pyrimidine, indole, purine, quinoline, triazine, etc.).

These nitrogen-containing hetero rings may further have substituents, examples of the substituents including alkyl groups, aryl groups, alkoxy groups, aryloxy groups, halogen atoms, a hydroxyl group, carbamoyl groups, and amino groups.

A polymer used in the present invention is preferably a polymer obtained from a vinyl monomer having such a nitrogen-containing hetero-ring. Specific examples include N-vinylpyrrolidone, N-vinylcaprolactam, acryloylmorpholine, acryloylthiomorpholine, N-vinylimidazole, 2-methyl-1-vinylimidazole, 2-vinylpyridine, 4-vinylpyridine, N-vinylcarbazole, N-methylmaleimide, N-ethylmaleimide, and 2-isopropenyl-2-oxazoline. Of these, N-vinylimidazole, 2-vinylpyridine, and 4-vinylpyridine are particularly preferable.

Furthermore, a polymer used in the present invention may be a copolymer between such a monomer and a monomer that can be copolymerized therewith. Examples of copolymerizable monomers include (meth)acrylic acid alkyl esters (e.g. C1-18 alkyl esters of (meth)acrylic acid such as methyl(meth) acrylate, ethyl(meth)acrylate, propyl(meth)acrylate, isopropyl(meth)acrylate, n-butyl(meth)acrylate, isobutyl(meth) acrylate, t-butyl(meth)acrylate, hexyl(meth)acrylate, octyl (meth)acrylate, 2-ethylhexyl(meth)acrylate, lauryl(meth) acrylate, and stearyl(meth)acrylate, etc.), (meth)acrylic acid cycloalkyl esters (e.g. cyclohexyl(meth)acrylate, etc.), (meth)acrylic acid aryl esters (e.g. phenyl(meth)acrylate, etc.), aralkyl esters (e.g. benzyl(meth)acrylate, etc.), substituted (meth)acrylic acid alkyl esters (e.g. 2-hydroxyethyl (meth)acrylate, etc.), (meth)acrylamides (e.g. (meth)acrylamide, dimethyl(meth)acrylamide, etc.), aromatic vinyl compounds (e.g. styrene, vinyltoluene, α-methylstyrene, etc.), vinyl esters (e.g. vinyl acetate, vinyl propionate, vinyl versatate, etc.), allyl esters (e.g. allyl acetate, etc.), halogen-containing monomers (e.g. vinylidene chloride, vinyl chloride, etc.), vinyl cyanides (e.g. (meth)acrylonitrile, etc.), and olefins (e.g. ethylene, propylene, etc.).

Of these copolymerizable monomers, (meth)acrylic acid alkyl esters, (meth)acrylamides, and aromatic vinyl compounds are preferable, with methyl(meth)acrylate, ethyl (meth)acrylate, propyl(meth)acrylate, isopropyl(meth)acrylate, n-butyl(meth)acrylate, isobutyl(meth)acrylate, t-butyl (meth)acrylate, hexyl(meth)acrylate, octyl(meth)acrylate, 2-ethylhexyl(meth)acrylate, 2-hydroxyethyl(meth)acrylate, and styrene being particularly preferable.

The "monomer having a nitrogen-containing hetero ring" content in the polymer having a nitrogen-containing hetero ring is preferably not less than 10 but not more than 100 mol %, more preferably not less than 20 but not more than 100 mol %.

A polymer as above can be synthesized through radical (co)polymerization of the monomer(s). As the radical polymerization, a publicly known method such as bulk polymerization, solution polymerization, or emulsion polymerization can be used. Moreover, a polymerization initiating catalyst well known to persons skilled in the art can be used as required.

Furthermore, a polymer used in the present invention may be obtained by polycondensation. Examples include polymers obtained through polycondensation between a 2,4-dichlorotriazine (e.g. 2,4-dichloro-6-butylamino-1,3,5-triazine) and a diamine (e.g. N,N'-dimethylethylenediamine, N,N'-dimethylhexamethylenediamine, N,N'-dibutylhexamethylenediamine, N,N'-dioctylhexamethylenediamine, etc.), and polymers obtained through polycondensation between a piperazine and a dicarboxylic acid (e.g. adipic acid) ester.

Preferable specific examples of polymers having a nitrogen-containing hetero ring are as follows.

P3-1

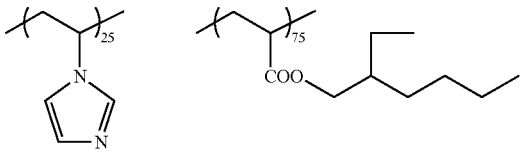

P3-2

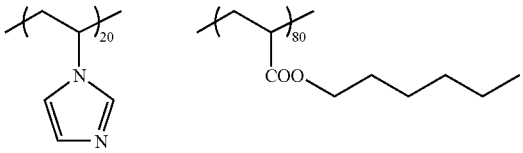

P3-3

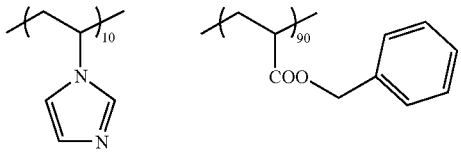

-continued

P3-4

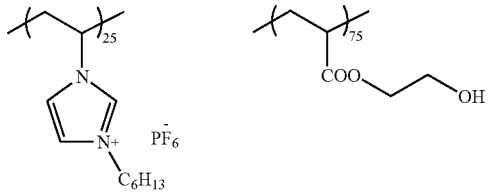

P3-5

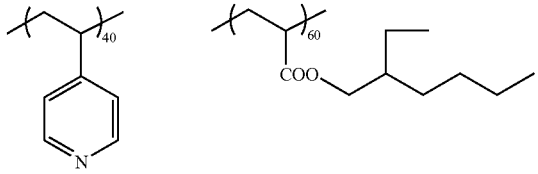

P3-6

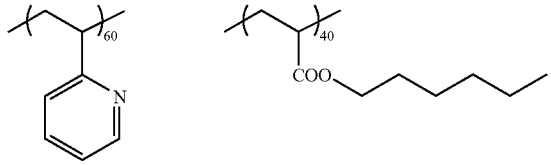

P3-7

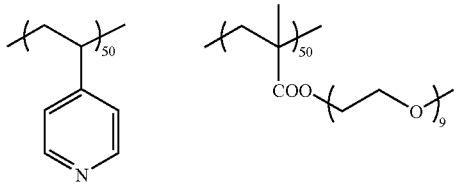

P3-8

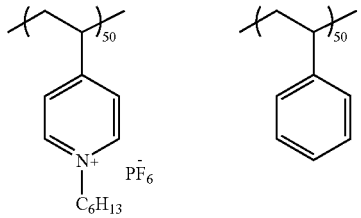

P3-9

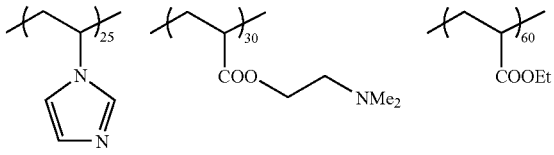

P3-10

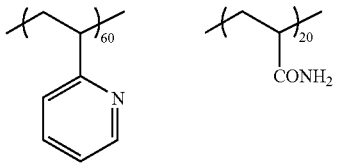

-continued
P3-11
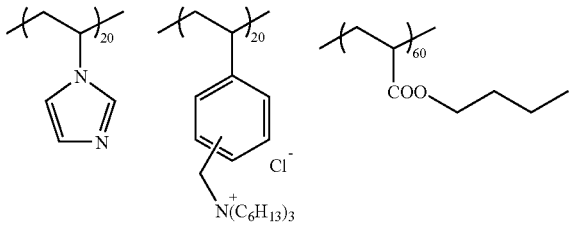
P3-12
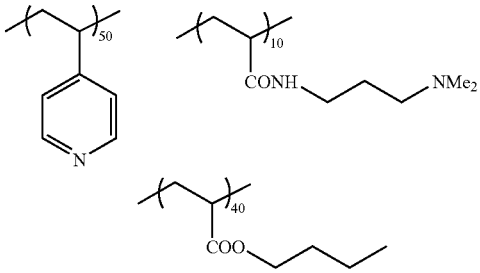
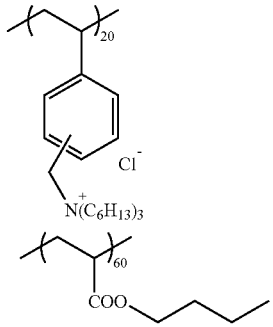
P3-12
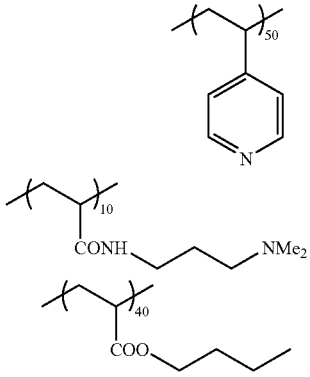
Furthermore, the following polymers are also preferable specific examples.
P3-13
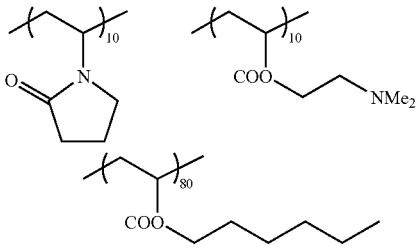
-continued
P3-14
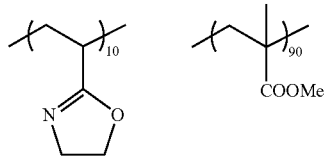
P3-15
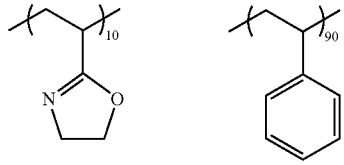
P3-16
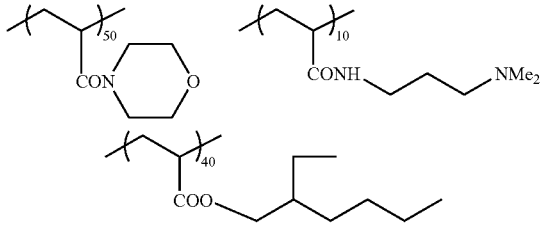
P3-17
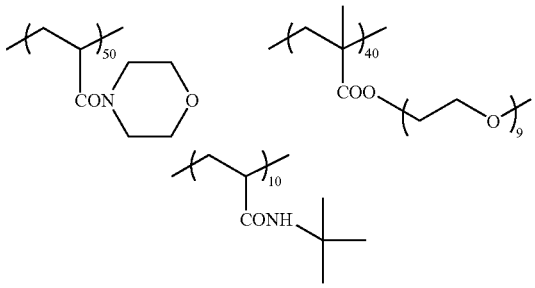
P3-18
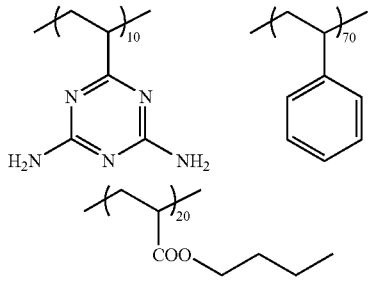
P3-19
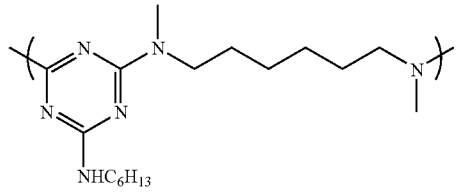
P3-20
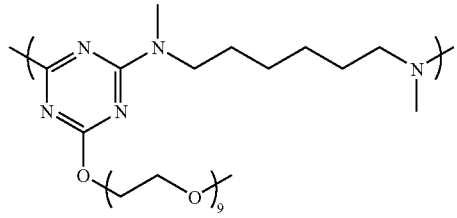

-continued

P3-21

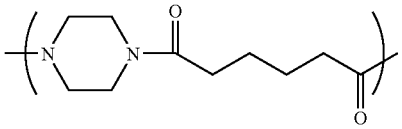

P3-22

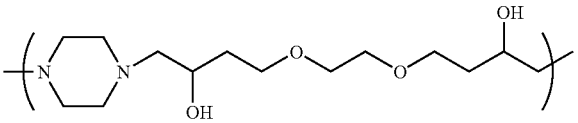

The weight average molecular weight of a polymer having a nitrogen-containing hetero ring used in the present invention is preferably not less than 1000 but not more than 50000, particularly preferably not less than 2000 but not more than 30000.

The amount used of the polymer having a nitrogen-containing hetero ring in the present invention is preferably in a range of 1 to 90% by mass, more preferably 10 to 75% by mass, particularly preferably 20 to 50% by mass, relative to all of each liquid. If the amount used is less than this, then it may not be possible to achieve the effects of the present invention effectively, whereas if the amount used is greater than this, then the viscosity may become high, and hence problems with the ink ejectability may arise.

Metal Compounds

Examples of metal compounds are metal salts of aliphatic carboxylic acids (e.g. acetic acid, propionic acid, butyric acid, valeric acid, isovaleric acid, pivalic acid, lauric acid, myristic acid, palmitic acid, stearic acid, 2-ethylhexanoic acid, lactic acid, pyruvic acid, etc.), metal salts of aromatic carboxylic acids (e.g. benzoic acid, salicylic acid, phthalic acid, cinnamic acid, etc.), metal salts of aliphatic sulfonic acids (e.g. methanesulfonic acid, ethanesulfonic acid, propanesulfonic acid, hexanesulfonic acid, 2-ethylhexanesulfonic acid, etc.), and metal salts of aromatic sulfonic acids (benzenesulfonic acid, naphthalenesulfonic acid, etc.), and also 1,3-diketone metal compounds. Of these, metal salts of aliphatic carboxylic acids, and 1,3-diketone metal compounds are preferable.

An aliphatic carboxylic acid as above may be straight chain, branched, or cyclic, and preferably has 2 to 40 carbon atoms, more preferably 6 to 25 carbon atoms. Moreover, the aliphatic carboxylic acid may have substituents, examples of the substituents including aryl groups, alkoxy groups, aryloxy groups, halogen atoms, a hydroxyl group, carbamoyl groups, amino groups, and a carboxy group.

Preferable examples of aryl groups as substituents include a phenyl group, alkylphenyl groups (e.g. a methylphenyl group, an ethylphenyl group, an n-propylphenyl group, an n-butylphenyl group, a cumenyl group, a mesityl group, a tolyl group, a xylyl group), a naphthyl group, a chlorophenyl group, a dichlorophenyl group, a trichlorophenyl group, a bromophenyl group, a hydroxyphenyl group, a methoxyphenyl group, an acetoxyphenyl group, and a cyanophenyl group, with a phenyl group and a naphthyl group being more preferable.

Preferable examples of alkoxy groups as substituents are a methoxy group, an ethoxy group, a propoxy group, an isopropoxy group, a butoxy group, a t-butoxy group, a hexyloxy group, a cyclohexyloxy group, a 2-ethylhexyloxy group, an octyloxy group, and a dodecyloxy group, with a methoxy group, an ethoxy group, a propoxy group, an isopropoxy group, a butoxy group, and a t-butoxy group being more preferable.

Preferable examples of aryloxy groups as substituents are a phenoxy group, a methylphenoxy group, an ethylphenoxy group, a cumenyloxy group, a tolyloxy group, a xylyloxy group, a naphthyloxy group, a chlorophenoxy group, a hydroxyphenoxy group, a methoxyphenoxy group, and an acetoxyphenoxy group, with a phenoxy group being more preferable.

Examples of halogen atoms as substituents are a fluorine atom, a chlorine atom, a bromine atom, and an iodine atom.

Preferable examples of carbamoyl groups as substituents are carbamoyl groups, alkylcarbamoyl groups (e.g. a methylcarbamoyl group, an ethylcarbamoyl group, a propylcarbamoyl group, a butylcarbamoyl group, etc.), and arylcarbamoyl groups (e.g. a phenylcarbamoyl group), with a carbamoyl group, a methylcarbamoyl group, and an ethylcarbamoyl group being more preferable.

Preferable examples of amino groups as substituents are a primary amino group, N-substituted amino groups (e.g. an N-methylamino group, an N-ethylamino group, an N-propylamino group, an N-butylamino group, an N-hexylamino group, an N-octylamino group, an N-benzylamino group), and N,N-disubstituted amino groups (e.g. an N,N-dimethylamino group, an N,N-diethylamino group, an N-methyl-N-ethylamino group, an N,N-dibutylamino group, an N-ethyl-N-octylamino group, an N-methyl-N-benzyl amino group), with an N-methylamino group, an N-ethylamino group, an N,N-dimethylamino group, an N,N-diethylamino group, and an N-methyl-N-ethylamino group being more preferable.

Particularly preferable aliphatic carboxylic acids are n-hexanoic acid, 2-ethylhexanoic acid, n-octanoic acid, lauric acid, myristic acid, palmitic acid, stearic acid, and 2-ethylhexanoic acid. Ethylenediaminetetraacetic acid is also a preferable example.

A 1,3-diketone as above may be may be straight chain, branched, or cyclic, and preferably has 5 to 40 carbon atoms, more preferably 5 to 25 carbon atoms. Examples include 2,4-pentadione, 3,5-heptadione, 2,2,6,6-tetramethylheptadione, 4,6-nonadione, 7,9-pentadecadione, 2,4-dimethyl-7,9-pentadecadione, 2-acetylcyclopentanone, 2-acetylcyclohexanone, 3-methyl-2,4-pentadione, 3-(2-ethylhexyl)2,4-pentadione, and 3-[4-(2-ethylhexyloxy)benzyl]-2,4-pentadione, with 2,4-pentadione, 7,9-pentadecadione, and 3-[4-(2-ethylhexyloxy)benzyl]-2,4-pentadione being preferable.

These groups may further have substituents, examples of the substituents including aryl groups, alkoxy groups, aryloxy groups, halogen atoms, a hydroxyl group, carbamoyl groups, amino groups, and a carboxy group. More preferable aryl groups, alkoxy groups, aryloxy groups, halogen atoms, hydroxyl groups, carbamoyl groups, and amino groups as substituents are as in the case of an aliphatic carboxylic acid described above.

An example of the metal in the metal compound is one selected from the group of zinc, aluminum, calcium, magnesium, iron, cobalt, nickel, and copper. Of these, zinc, aluminum, and nickel are preferable, with zinc being particularly preferable.

Preferable metal salts of aliphatic carboxylic acids in the present invention are as follows.

1-1
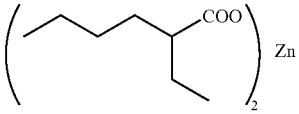
1-2
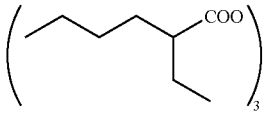
1-3
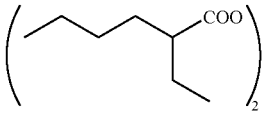
1-4
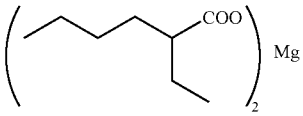
1-5
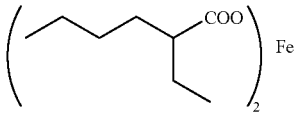
1-6
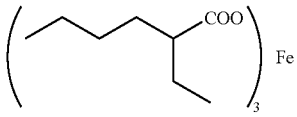
1-7
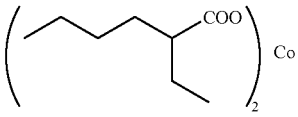
1-8
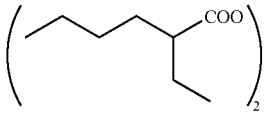
1-9
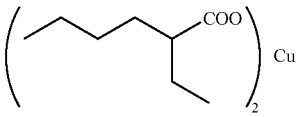
1-10
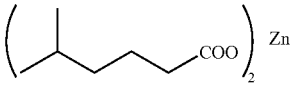
1-11
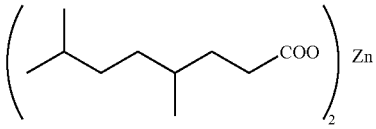
1-12
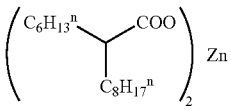
-continued
1-13
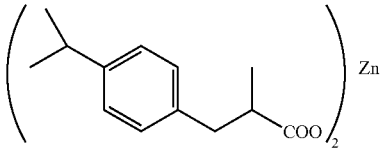
1-14
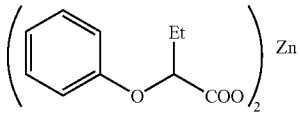
1-15
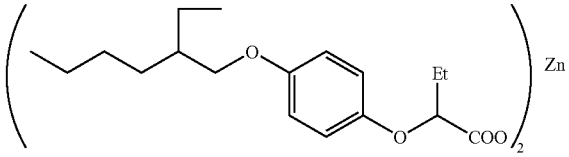
1-16
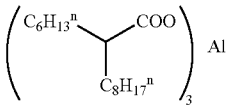
Furthermore, preferable specific examples of 1,3-diketone metal compounds in the present invention are as follows.
2-1
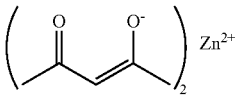
2-2
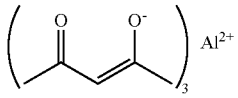
2-3
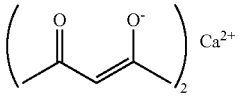
2-4
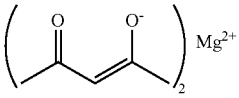
2-5
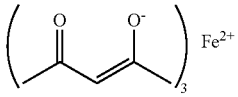
2-6
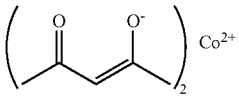
2-7
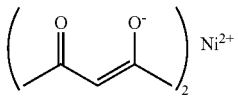

-continued 2-8

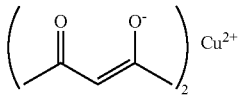

2-9

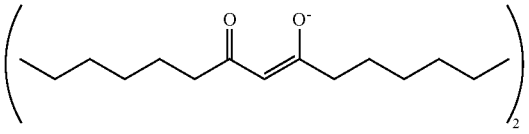

2-10

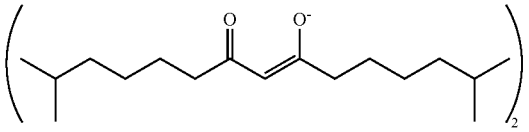

2-11

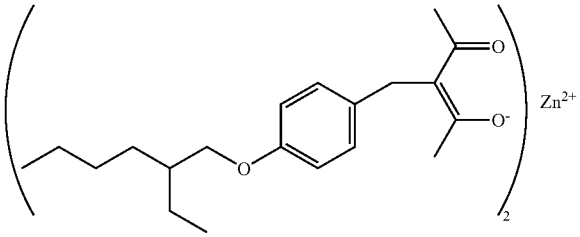

A metal salt of an aliphatic carboxylic acid or a 1,3-diketone metal compound as above can be synthesized through complexation in a solution. Alternatively, there is no limitation to this, but rather another publicly known method may be used.

The amount used of the metal compound in the present invention is preferably in a range of 1 to 90% by mass, more preferably 10 to 75% by mass, particularly preferably 20 to 50% by mass, relative to all of each liquid. If the amount used is less than this, then it may not be possible to achieve the effects of the present invention effectively, whereas if the amount used is greater than this, then the viscosity may become high, and hence problems with the ink ejectability may arise.

High-Boiling Organic Solvents (Oils)

In the present invention, "high-boiling organic solvent" refers to an organic solvent that has a viscosity at 25° C. of not more than 100 mPa·s or a viscosity at 60° C. of not more than 30 mPa·s, and has a boiling point higher than 100° C.

Here, "viscosity" in the present invention refers to the viscosity obtained using a RE80 viscometer made by Toki Sangyo Co., Ltd. The RE80 viscometer is a conical rotor/flat plate type viscometer corresponding to the E type, and measurement is carried out using a rotor code No. 1 rotor at a rotational speed of 10 rpm. Note, however, that in the case of a viscosity higher than 60 mPa·s, measurement is carried out with the rotational speed changed to 5 rpm, 2.5 rpm, 1 rpm, 0.5 rpm, or the like as required.

Moreover, "solubility of water" in the present invention means the saturated concentration of water in the high-boiling organic solvent at 25° C., this being the mass (g) of water that can be dissolved in 100 g of the high-boiling organic solvent at 25° C.

The amount used of the high-boiling organic solvent is preferably 5 to 2000% by mass, more preferably 10 to 1000% by mass, in terms of the consumed amount relative to the colorant used.

In the present invention, various compounds are preferable as the high-boiling organic solvent.

Storage Stabilizer

In the present invention, a storage stabilizer may be added to each of the plurality of liquids with an object of suppressing undesirable polymerization during storage of the liquid. The storage stabilizer is preferably used in each of the liquids having the polymerizable compound(s) therein. Moreover, it is preferable to use a storage stabilizer that is soluble in the liquid or other coexisting components.

Examples of the storage stabilizer include quaternary ammonium salts, hydroxyamines, cyclic amides, nitrile compounds, substituted ureas, heterocyclic compounds, organic acids, hydroquinones, hydroquinone monoethers, organic phosphines, and copper compounds.

The amount added of the storage stabilizer is preferably adjusted as appropriate on the basis of the activity of the polymerization initiator used, the polymerizability of the polymerizable compound(s), and the type of the storage stabilizer. From the viewpoint of balance between the storage stability and the curability of the ink upon mixing the liquids, the amount added of the storage stabilizer is preferably 0.005 to 1% by mass, more preferably 0.01 to 0.5% by mass, yet more preferably 0.01 to 0.2% by mass, in terms of solid content in the liquid.

Liquid Applying Device

In the inkjet image recording method according to embodiments of the present invention, as a device for applying the second liquid onto the recording medium, a device where the second liquid is jetted from inkjet nozzles may be used, or another device such as a coating device may be used.

There are no particular limitations on the above coating device, and it is possible to select a publicly known coating device as appropriate in accordance with the object. The examples include an air doctor coater, a blade coater, a rod coater, a knife coater, a squeeze coater, a dip coater, a reverse roll coater, a transfer roll coater, a gravure coater, a kiss roll coater, a cast coater, a spray coater, a curtain coater, and an extrusion coater.

Energy Applying Process

For an exposing light source for promoting polymerization of the polymerizable compound(s) in the present invention, ultraviolet radiation or visible light may be used. Moreover, the application of energy may be carried out using radiation other than light, such as α-rays, γ-rays, X-rays, or an electron beam; however, from the viewpoints of cost and safety, it is preferable to use ultraviolet radiation or visible light, with it being more preferable to use ultraviolet radiation. The amount of energy required for the curing reaction varies depending on the type and content of polymerization initiator, and is generally approximately 1 to 500 mJ/cm$^2$.

Description of Curing Energy

In the inkjet recording apparatus 10 shown in the present example, from the viewpoint of obtaining excellent fixation, there is a process of fixing the image on the recording paper 16 by applying energy after the image has been formed.

That is, by applying energy to the treatment liquid and the colored inks that have been deposited onto the recording paper 16, polymerization and curing of these liquids are promoted, whereby a firmer image can be formed more efficiently. In the present example, the application of energy is carried out by performing irradiation of radiation such as UV.

That is, by applying energy (UV) from a UV light source 24, generation of active species by decomposition of the polymerization initiator in the liquids that have been deposited on the recording medium 16 is promoted, and moreover by increasing the amount of the active species or increasing the temperature, polymerization and curing of the polymerizable compound(s) by the active species are promoted.

In the present example, one example of an exposing light source for promoting the polymerization of the polymerizable compound(s) has been given as being an ultraviolet radiation light source, but other than this, the application of energy may be carried out by performing irradiation of visible light, α-rays, γ-rays, X-rays, an electron beam, or the like. Of these, from the viewpoints of cost and safety, it is preferable to use ultraviolet radiation or visible light, with it being more preferable to use ultraviolet radiation. The amount of energy required for the curing reaction varies depending on the type and content of polymerization initiator, and is generally approximately 1 to 500 $mJ/cm^2$.

Examples of the UV light source 24 used in the inkjet recording apparatus 10 in the present example include metal halide lamps, xenon lamps, high-pressure mercury lamps, low-pressure mercury lamps, carbon arc lamps, sterilizing lamps, UV fluorescent lamps, and UV LEDs.

Description of Recording Medium

In the present invention, either an ink-permeable recording medium, or a non-ink-permeable recording medium may be used. Examples of ink-permeable recording media include plain paper, inkjet-specific paper, coated paper, multi-use paper compatible with inkjet and electrophotography, a cloth, a nonwoven cloth, a porous film, and a polymeric absorbent. These are described as "member on which recording is carried out" in Japanese Patent Application Publication No. 2001-181549 etc.

The excellent effects of the present invention are remarkable with a non-ink-permeable recording medium. Examples of non-ink-permeable recording media include art paper, synthetic resins, rubber, resin-coated paper, glass, metal, ceramics, and wood. In addition, to add functionality, a composite substrate in which a plurality of these materials are combined may be used.

As a synthetic resin, any synthetic resin may be used. Examples include polyesters such as polyethylene terephthalate and polybutadiene terephthalate, polyvinyl chloride, polystyrene, polyethylene, polyurethanes, polyolefins such as polypropylene, acrylic resins, polycarbonates, acrylonitrile-butadiene-styrene copolymers and so on, diacetates, triacetates, polyimides, cellophane, and celluloid. There are no limitations on the thickness or shape of the synthetic resin substrate, which may be a film, a card, or a block. Moreover, the synthetic resin may be transparent or opaque.

As the mode of use of the synthetic resin, use in the form of a film used in so-called flexible packaging is also preferable, it being possible to use a film of any of various non-absorbent plastics, examples of the various plastic films including a PET film, an OPS film, an OPP film, a PNy film, a PVC film, a PE film, and a TAC film. As other plastics, a polycarbonate, an acrylic resin, ABS, polyacetal, PVA, rubber, or the like can be used.

Examples of resin-coated paper include a paper support laminated with a polyolefin resin on both surfaces of the paper, or a transparent polyester film, an opaque polyester film, or an opaque polyolefin resin film. Particularly preferable is a paper support laminated with a polyolefin resin on both surfaces of the paper.

As a metal, any metal can be used, it being preferable to use aluminum, iron, gold, silver, copper, nickel, titanium, chromium, molybdenum, silicon, lead, zinc, or the like, or a composite material thereof such as stainless steel.

Moreover, as the recording medium used in the present invention, it is also possible to use a read only optical disk such as a CD-ROM or a DVD-ROM, a write once type optical disk such as a CD-R or a DVD-R, or a rewritable optical disk, an ink-receiving layer and a luster-conferring layer being applied onto the label surface side thereof.

As described above, according to the present embodiment, the ink ejected from abnormal nozzles for which a landing position error is not less than a predetermined amount is ejected continuously to an extent that the deposited dots make contact with one another on the recording medium. As a result, flat dots are formed on the recording medium, whereby the visibility of streakiness caused by the landing position error can be reduced effectively.

In particular, in the present embodiment, a treatment liquid containing a curing initiator (a polymerization initiator), a diffusion preventing agent, and an oil, and colored inks each containing a UV monomer and a coloring material are used, and the treatment liquid is deposited onto the recording medium prior to the colored inks. As a result, image degradation caused by liquid deposition interference can be prevented; meanwhile, the mixture of the treatment liquid and the colored inks on the recording medium is irradiated with UV, whereby the mixture is rapidly cured and thus fixed, so that a good quality image can be obtained.

Note that in the present embodiment, description is given for the case where each ejection head is a full line type head. However, there is no limitation to this when implementing the present invention, but rather a shuttle type head that ejects ink while scanning in the paper width direction (the main scanning direction) orthogonal to the paper conveyance direction of the recording medium (the sub-scanning direction) may be used.

The image forming apparatus according to the present invention has been described in detail above. However, the present invention is not limited to the above examples, but rather any of various modifications may of course be made so long as such modifications fall within a scope so as not to deviate from the gist of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

a liquid ejection head including a plurality of nozzles, the liquid ejection head ejecting a first liquid containing a coloring material through the nozzles onto a recording medium while the liquid ejection head and the recording medium are relatively moved in a first direction;

an abnormal nozzle identifying device which identifies, out of the nozzles, an abnormal nozzle for which an error in a landing position of the first liquid on the recording medium with respect to a second direction orthogonal to the first direction is not less than a predetermined amount; and a correcting device which corrects dot data in such a manner that a second dot on the recording medium formed from the first liquid subsequently ejected from the abnormal nozzle makes contact with at least part of a first dot on the recording medium formed from the first liquid previously ejected from the abnormal nozzle wherein when one of the nozzles ejects droplets of the first liquid continuously at a frequency higher than a predetermined frequency so that the ejected droplets are deposited on the recording medium to make contact with one another, the deposited droplets spread out more in the second direction than in other directions and form spread dots on the recording medium, and wherein in a case where there are the abnormal nozzles adjacent to one another in a projected nozzle row obtained by projecting the nozzles so that the nozzles are aligned in the second direction, the correcting device corrects the dot data in such a manner that a third dot formed by one of the abnormal nozzles and a fourth dot formed by the other of the abnormal nozzles are not aligned in the second direction.

2. The image forming apparatus as defined in claim 1, wherein a total number of dots formed by the abnormal nozzle in a predetermined area according to the dot data which is not corrected by the correcting device is the same as a total number of dots formed by the abnormal nozzle in the predetermined area according to the dot data which is corrected by the correcting device.

3. The image forming apparatus as defined in claim 1, further comprising an attaching device which attaches a second liquid containing a diffusion preventing agent for the coloring material onto the recording medium before the first liquid is attached onto the recording medium.

4. The image forming apparatus as defined in claim 3, further comprising a radiation irradiation device which radiates radiation onto the recording medium, wherein one of the first liquid and the second liquid further contains a radiation-curable polymerizable compound, and the other further contains a polymerization initiator.

5. The image forming apparatus as defined in claim 3, wherein the second liquid further contains a high-boiling organic solvent.

6. The image forming apparatus as defined in claim 1, wherein each of the deposited droplets spreads out more in a direction toward an area in which no dot formed from the first liquid has been present than in a direction toward an area in which a dot formed from the first liquid has been present.

7. The image forming apparatus as defined in claim 1, wherein the deposited droplets spread less in the first direction than in other directions and form the spread dots on the recording medium.

8. An image forming apparatus comprising:

a liquid ejection head including a plurality of nozzles, the liquid ejection head ejecting a first liquid containing a coloring material through the nozzles onto a recording medium while the liquid ejection head and the recording medium are relatively moved in a first direction;

an abnormal nozzle identifying device which identifies, out of the nozzles, an abnormal nozzle for which an error in a landing position of the first liquid on the recording medium with respect to a second direction orthogonal to the first direction is not less than a predetermined amount; and a correcting device which corrects dot data in such a manner that a second dot on the recording medium formed from the first liquid subsequently ejected from the abnormal nozzle makes contact with at least part of a first dot on the recording medium formed from the first liquid previously ejected from the abnormal nozzle, wherein when one of the nozzles ejects droplets of the first liquid continuously at a frequency higher than a predetermined frequency so that the ejected droplets are deposited on the recording medium to make contact with one another, the deposited droplets spread out more in the second direction than in other directions and form spread dots on the recording medium, and wherein in a case where the abnormal nozzle is not adjacent to another abnormal nozzle in a projected nozzle row obtained by projecting the nozzles so that the nozzles are aligned in the second direction, the correcting device also corrects the dot data for a nozzle adjacent to the abnormal nozzle on a side opposite to a side on which the error with respect to the second direction arises.

9. An image forming apparatus comprising:

a liquid ejection head including a plurality of nozzles, the liquid ejection head ejecting a first liquid containing a coloring material through the nozzles onto a recording medium while the liquid ejection head and the recording medium are relatively moved in a first direction;

an abnormal nozzle identifying device which identifies, out of the nozzles, an abnormal nozzle for which an error in a landing position of the first liquid on the recording medium with respect to a second direction orthogonal to the first direction is not less than a predetermined amount; and a correcting device which corrects dot data in such a manner that a second dot on the recording medium formed from the first liquid subsequently ejected from the abnormal nozzle makes contact with at least part of a first dot on the recording medium formed from the first liquid previously ejected from the abnormal nozzle, wherein in a case where there are the abnormal nozzles adjacent to one another in a projected nozzle row obtained by projecting the nozzles so that the nozzles are aligned in the second direction, the correcting device corrects the dot data in such a manner that a third dot formed by one of the abnormal nozzles and a fourth dot formed by the other of the abnormal nozzles are not aligned in the second direction.

10. An image forming apparatus comprising:

a liquid ejection head including a plurality of nozzles, the liquid ejection head ejecting a first liquid containing a coloring material through the nozzles onto a recording medium while the liquid ejection head and the recording medium are relatively moved in a first direction;

an abnormal nozzle identifying device which identifies, out of the nozzles, an abnormal nozzle for which an error in a landing position of the first liquid on the recording medium with respect to a second direction orthogonal to the first direction is not less than a predetermined amount; and a correcting device which corrects dot data in such a manner that a second dot on the recording medium formed from the first liquid subsequently ejected from the abnormal nozzle makes contact with at least part of a first dot on the recording medium formed from the first liquid previously ejected from the abnormal nozzle, wherein in a case where the abnormal nozzle is not adjacent to another abnormal nozzle in a projected nozzle row obtained by projecting the nozzles so that the nozzles are aligned in the second direction, the correcting device also corrects the dot data for a nozzle adjacent to the abnormal nozzle on a side opposite to a side on which the error with respect to the second direction arises.

* * * * *